US006505684B2

(12) United States Patent
Rayssiguier et al.

(10) Patent No.: US 6,505,684 B2
(45) Date of Patent: Jan. 14, 2003

(54) HYDRAULIC ACTUATOR

(75) Inventors: Christophe M. Rayssiguier, Houston, TX (US); Vong Vongphakdy, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 9 days.

(21) Appl. No.: 09/778,362

(22) Filed: Feb. 7, 2001

(65) Prior Publication Data

US 2002/0046843 A1 Apr. 25, 2002

Related U.S. Application Data

(60) Provisional application No. 60/242,162, filed on Oct. 20, 2000.

(51) Int. Cl.[7] ..... E21B 33/12

(52) U.S. Cl. ..... 166/375; 166/381; 166/237

(58) Field of Search ..... 166/375, 381, 166/383, 319, 237, 240

(56) References Cited

U.S. PATENT DOCUMENTS

| | | | | |
|---|---|---|---|---|
| 2,307,949 A | | 1/1943 | Phillips | |
| 3,454,029 A | | 7/1969 | Fredd | |
| 3,967,647 A | | 7/1976 | Young | |
| 4,084,613 A | | 4/1978 | Peters | |
| 4,217,934 A | | 8/1980 | Peters | |
| 4,402,517 A | | 9/1983 | Wood et al. | |
| 4,481,864 A | * | 11/1984 | Peruzzi | 91/44 |
| 4,524,831 A | | 6/1985 | Pringle | |
| 4,621,695 A | | 11/1986 | Pringle | |
| 4,660,646 A | | 4/1987 | Blizzard | |
| 4,660,647 A | | 4/1987 | Richart | |
| 4,718,494 A | * | 1/1988 | Meek | 166/373 |
| 4,770,250 A | | 9/1988 | Bridges et al. | |
| 5,058,673 A | | 10/1991 | Muller et al. | |
| 5,323,853 A | | 6/1994 | Leismer et al. | |
| 5,826,661 A | | 10/1998 | Parker et al. | |
| 5,832,996 A | | 11/1998 | Carmody et al. | |
| 5,947,205 A | | 9/1999 | Shy | |
| 5,957,207 A | | 9/1999 | Schnatzmeyer | |
| 5,971,004 A | | 10/1999 | Pringle | |
| 6,012,518 A | | 1/2000 | Pringle et al. | |
| 6,085,845 A | | 7/2000 | Patel et al. | |
| 6,119,783 A | | 9/2000 | Parker et al. | |

* cited by examiner

*Primary Examiner*—William Neuder
(74) *Attorney, Agent, or Firm*—Tim W. Curington; Jeffrey W. Griffin; Brigitte L. Jeffery

(57) ABSTRACT

The present invention provides a hydraulic actuator adapted for use in downhole well applications that enables control of several hydraulic devices from a single control line.

22 Claims, 27 Drawing Sheets

HYDRAULIC ACTUATOR

This application claims the benefit of U.S. Provisional Application No. 60/242,162, filed Oct. 20, 2000.

FIELD OF THE INVENTION

The present invention relates to well completion equipment, and more specifically to mechanisms for actuating downhole well tools that require pressurized hydraulic fluid to operate.

BACKGROUND OF THE INVENTION

It is well known that many downhole devices require power to operate, or shift from position to position in accordance with the device's intended purpose. A surface controlled subsurface safety valve (SCSSV) requires hydraulic and/or electrical energy from a source located at the surface. Setting a packer that is sealably attached to a string of production tubing requires either a tubing plug together with application of pressure on the tubing, or a separate and retrievable "setting tool" to actuate and set the packer in the tubing. Sliding sleeves or sliding "side door" devices may also require hydraulic activation. It will become apparent to anyone of normal skill in the art that many downhole devices requiring power for actuation can be adapted to utilize this invention. Such devices may comprise: packers, such as those disclosed in U.S. Pat. Nos. 5,273,109, 5,311,938, 5,433,269, and 5,449,040; perforating equipment, such as disclosed in U.S. Pat. Nos. 5,449,039, 5,513,703, and 5,505,261; locking or unlocking devices, such as those disclosed in U.S. Pat. Nos. 5,353,877 and 5,492,173; valves, such as those disclosed in U.S. Pat. Nos. 5,394,951 and 5,503,229; gravel packs, such as those disclosed in U.S. Pat. Nos. 5,531,273 and 5,597,040; flow control devices or well remediation tools, such as those disclosed in U.S. Pat. Nos. 4,429,747, and 4,434,854; and plugs or expansion joints, of the type well known to those in the art.

Each of these well known devices has a method of actuation, or actuation mechanism that is integral and specific to the tool. Consequently, in the past, most of these well known devices have required an independent source of power. There is a need for a device that can provide one or more sources of pressurized hydraulic fluid into the downhole environment, enabling actuation of any number of downhole tools. The device should be adaptable for various downhole tasks in various downhole tools, and be simple to allow for redress in the field. It should also be adaptable for permanent installation in the completion, thereby allowing multiple functions to be performed on multiple tools located therein, all controlled by an operator at a control panel on the earth's surface.

BRIEF DESCRIPTION OF THE INVENTION

A full understanding of the present invention will be obtained from the detailed description of the preferred embodiment presented herein below, and the accompanying drawings, which are given by way of illustration only and are not intended to be limitative of the present invention, and wherein:

FIG. 15D provides a perspective view wherein the ratchet assembly is shown in a cut-away cross sectional view, and FIG. 15E provides a cross-section taken along line 15E in FIG. 15D.

DETAILED DESCRIPTION OF THE INVENTION

In the following detailed description of the subject matter of the present invention, the invention is principally described as being used in oil well applications. Such applications are intended for illustration purposes only and are not intended to limit the scope of the present invention. The present invention can also be used to advantage in operations within gas wells, water wells, injection wells, control wells, and other applications requiring remote hydraulic control. All such applications are intended to fall within the purview of the present invention. However, for purposes of illustration, the present invention will be described as being used for oil well applications.

Additionally, in the following detailed description of the subject matter of the present invention, the invention is principally described as being used to supply hydraulic devices with hydraulic fluid pressure from a main control line. Such hydraulic devices include, but are not limited to, hydraulic tools, hydraulic actuators, and hydraulic distributors, for example. All such applications are intended to fall within the purview of the present invention.

Figure 1:
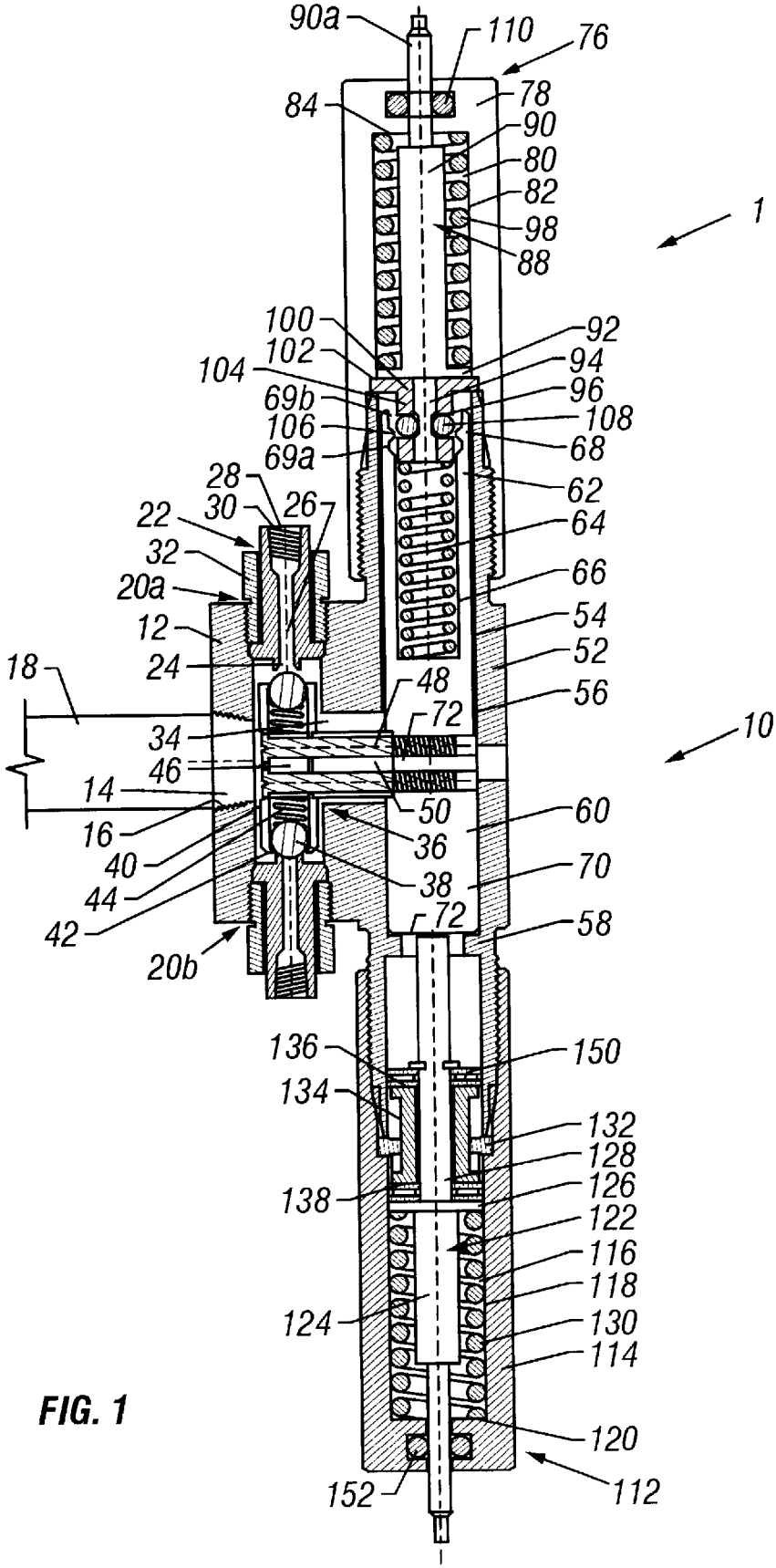
FIG. 1 is a cross-sectional view of an embodiment of the hydraulic distributor of the present invention.

In describing the present invention and its operation, it is important to note that directional terms such as "up", "down", "upper", "lower", are used to facilitate discussion of the example. However, the present invention can be used to advantage in any axially orientation. However, for purposes of illustration, certain directional terms relating to the orientation on the drawing page will be used. FIG. 1 is a cross-sectional view of an embodiment of the hydraulic distributor 1 of the present invention. The main body 10 of the hydraulic distributor 1 serves as its chassis and comprises a flow control housing 12 and an actuator housing 52 that are in coupled communication to channel the hydraulic fluid pressure from the main control line 18. It should be noted that although in this embodiment of the present invention the main body 10 is a unitary component having two housings 12, 52, in alternate embodiments within the scope of the present invention, the main body 10 can be comprised of other configurations such as, for example, separate, but affixed housings 12, 52.

Hydraulic fluid pressure from the main control line 18 is received by an inlet port 14 in the flow control housing 12. In this embodiment of the hydraulic distributor 1, the inlet port 14 has a series of inlet threads 16 for sealingly engaging the nozzle of the main control line. However, there are a multiplicity of ways in which the main control line can engage the inlet port 14 of the flow control housing 12 such as flanged connections, quick-connect fittings, welded connections, and the like. All such ways are intended to fall within the purview of the present invention. The flow entering the inlet port 14 is distributed to a plurality of outlet ports 20*a*, 20*b*. The outlet ports 20*a*, 20*b* provide the conduit for supplying hydraulic fluid pressure to hydraulic devices.

In an embodiment of the present invention, each outlet port 20*a*, 20*b* houses a seating element 22 that controls the flow therethrough the outlet ports 20*a*, 20*b*. Each seating element 22, in this embodiment, is maintained within the outlet ports 20*a*, 20*b* by a seal nut 32.

It should be noted that in alternate embodiments, the seating element 22 is maintained within the outlet ports 20*a*, 20*b* by means such as welds, solders, threaded connections, or the like. In still further alternate embodiments, the seating element 22 is integral with the outlet ports 20*a*, 20*b*.

Figure 2:
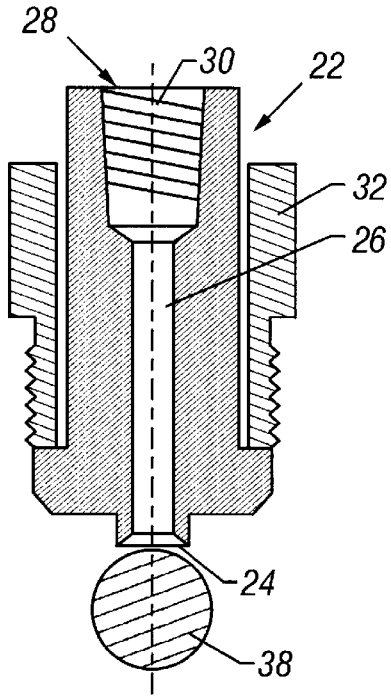
FIG. 2 is a cross-sectional view of the seating element and seal nut of an embodiment of the hydraulic distributor.

As best described with reference to FIG. 2, each seating element 22 provides a seating surface 24 that is a mating surface for a spring-controlled actuation ball 38 (discussed below) to redirect fluid communication. When the actuation ball 38 is in mating contact with the seating surface 24, fluid is prevented from entering and traveling through the internal conduit 26 that extends therethrough the seating element 22. Conversely, when the actuation ball 38 is not in mating contact with the seating surface 24, fluid may flow through the internal conduit 26. In an alternate embodiment, the seating surface 24 is energized by a spring, for example, to further secure the mating engagement with the actuation balls 38.

At the distal end of the internal conduit 26 is a tool interface port 28 that provides the interface to supply fluid flow from the internal conduit 26 to the hydraulic devices. The tool interface port 28 is provided with internal threads 30 for engagement with the attached hydraulic devices. However, alternate connections for engagement may be utilized depending upon the type of hydraulic device. Such connections include, but are not limited to, flanged connections, quick-connect fittings, welded connections, and the like. All such ways are intended to remain within the purview of the present invention.

Referring back to FIG. 1, the flow control housing 12 is further defined by a control chamber 34. The control chamber 34 is an internal channel within the flow control housing 12 that extends from the inlet port 14 to the outlet ports 20*a*, 20*b* and extends from the inlet port 14 to the actuator housing 52. Housed within the control chamber 34 is a supply alternator 36. The supply alternator 36 controls the distribution of the hydraulic fluid pressure from the inlet port 14 to the appropriate outlet port 26*a*, 26*b*.

In the embodiment of FIG. 1, the supply alternator 36 is comprised of a ball housing 40 that houses a plurality of actuation balls 38, ball springs 44 and spring spacer 46. The ball housing 40 is oriented within the control chamber 34 such that it is axially aligned with the longitudinal axis of the seating elements 22. The ball housing 40 has a retaining shoulder 42 at each distal end of the ball housing 40. Intermediate within the ball housing 40 is the spring spacer 46 that acts as a base for the opposing ball springs 44 that bias the actuation balls 38 towards each retaining shoulder 42. The retaining shoulders 42 prevent further outward movement of the actuation balls 38.

A plurality of control screws 48 are affixed to and extend therefrom the ball housing 40 in a direction perpendicular to the axial orientation of the ball housing 40. To maintain the spacing and orientation of the control screws 48, a control screw spacer 50 is provided from which the control screws 48 extend therefrom. The control screws 48 extend from the ball housing 40 and are affixed to a shuttle sleeve 60 (discussed below) housed within the actuator housing 52. Although shown as screws, the "control screws 48" may be any member capable of connecting the ball housing 40 to the shuttle sleeve 60. For example, the "control screws 48" can be an arm, an integrally formed connector, or any other connection.

The actuator housing 52 has a locking end 76, an indexing end 112, and defines an internal bore 54. The internal bore 54 is defined by the interior walls 56 of the actuator housing 52 and extends therethrough the actuator housing 52. The internal bore 54 is further defined by a bore shoulder 58.

A shuttle sleeve 60 having a lock end 62 and an index end 70 resides within the internal bore 54 such that the shuttle sleeve 60 can travel axially therethrough. The lock end 62 of the shuttle sleeve 60 provides a shuttle sleeve spring 64 within a shuttle spring housing 66. The lock end 62 further provides a locking profile 68 that is defined by a series of recesses 69*a*, 69*b*. The index end 70 provides a base surface 72 that abuts the bore shoulder 58 to limit the travel of the shuttle sleeve 60 towards the indexing end 112 of the actuator housing 52.

The shuttle sleeve 60 further provides a control screw receptacle 74 for fixed engagement with the control screws 48 originating in the supply alternator. Because of the substantially rigid fixation, movement of the shuttle sleeve 60 controls the movement of the supply alternator 36.

A lock piston housing 78 is affixed to the locking end 76 of the actuator housing 52. The lock piston housing 78 has a lock piston chamber 80 defined by opposing interior walls 82 and a chamber base 84. In an alternate embodiment, a spacer (such as stack of washers) is located on the chamber base 84.

A lock piston 88 is located and maneuverable within the lock piston chamber 80. The lock piston 88 is comprised of a piston rod 90, a flange 92, and a control rod 94. The lock piston further comprises a piston shaft 90*a* that enables external manipulation of the lock piston 88 (as will be discussed below). A lock piston seal 110 maintains the fluid pressure within the lock piston chamber 80. It should be noted that the lock piston seal 110 shown in FIG. 1 is exemplary of one embodiment of the present inventionAny number of seal arrangements of the present invention. Any number of seal could be utilized to advantage in the present invention. To fall within the purview of the present invention it is only necessary that the seal arrangement act to prevent loss of fluid within the actuator housing 52.

The control rod 94 of the lock piston 88 extends from the flange 92 opposite the piston rod 90. The control rod 94 has a tapered detent 96 utilized to manipulate a plurality of locking balls 108 as will be discussed below. The distal end of the control rod 94 extends within the lock end 62 of the shuttle sleeve 60.

A lock spring 98 located within the lock piston chamber 80 is utilized to bias the lock piston rod 90 away from the chamber base 84. The lock spring 98 applies biasing force against the flange 92 of the lock piston rod 90. The stroke of the lock piston rod 90 away from the chamber base 84 is limited, and defined by, the location of a fixed cage 100. The fixed cage 100 having a limiting shoulder 102 is affixed to the interior walls 82 of the lock piston chamber 80. The limiting shoulder 102 resists movement of the piston rod 90 resulting from the bias of the lock spring 98 when the flange 92 abuts the limiting shoulder 102. Thus, the stroke of the lock piston rod 90 is controlled by the location of the fixed cage 100.

The fixed cage 100 further has a lock ball housing 104. The lock ball housing 104 extends within the lock end 62 of the shuttle sleeve 60 and receives of the control rod 94 of the lock piston 88 therethrough. The lock ball housing 104 defines a plurality of receptacles 106 for the receipt of the lock balls 108. The lock ball housing 104 provides the base for the shuttle sleeve spring 64 located within the shuttle sleeve spring housing 66.

As will be discussed further below, the relational positions of the control rod 94, the lock ball housing 104, and the lock balls 108 control whether the shuttle sleeve 60 is engaged by the fixed cage 100 thereby preventing axial movement by the shuttle sleeve 60. As shown in FIG. 1, the shuttle sleeve 60 is in an unlocked position in which the lock balls 108 are not engaging the recesses 69*a*, 69*b* of the shuttle sleeve 60, but are rather residing within the tapered detent 96 of the control rod 94. However, it should be understood that downward (with respect to the drawing page) axial movement of the control rod 94 will result in the lock balls 108 being forced out of the tapered detent 96 of the control rod 94 and into engagement with one of the recesses 69*a*, 69*b* of the shuttle sleeve 60, thereby preventing the shuttle sleeve 60 from further axial movement. Upon an upward movement by the control rod 94, the lock balls 108 release from engagement with the shuttle sleeve 60 and again reside in the tapered detent 96 of the control rod 94.

An indexer piston housing 114 is affixed to the indexing end 112 of the actuator housing 52. The index piston housing 114 has an indexer piston chamber 116 defined by opposing interior walls 118 and a chamber base 120. In an alternate embodiment, a spacer (such as a stack of washers) is located on the chamber base 120.

An indexer piston 122 is located and maneuverable within the indexer piston chamber 116. The indexer piston 122 is comprised of a piston rod 124, a flange 126, and a control rod 128. An indexer piston seal maintains the fluid pressure within the indexer piston chamber 116. As discussed above with reference to the lock piston seal 110, it should be noted that the indexer piston seal 152 shown in FIG. 1 is exemplary of one embodiment of the present invention. Any number of seal arrangements could be utilized to advantage in the present invention. To fall within the purview of the present invention it is only necessary that the seal arrangement act to prevent loss of fluid within the actuator housing.

The control rod 128 of the indexer piston 122 extends from the flange 126 opposite the piston rod 124. The control rod 128 is utilized to manipulate the shuttle sleeve 60, as will be discussed below. The control rod 128 extends within the indexing end 112 of the actuator housing 52.

An indexer spring 130 located within the indexer piston chamber 116 is utilized to bias the indexer piston rod 124 away from the chamber base 120. The indexer spring 130 applies biasing force against the flange 126 of the indexer piston rod 124. The stroke of the indexer piston rod 124 resulting from the spring bias is limited, and defined by, the location of an indexer sleeve 134 with relation to an indexer pin 132.

The indexer sleeve 134 is housed within thrust bearings 150 and is affixed to the indexer piston 122 such that axial movement of the indexer piston 122 results in axial movement of the indexer sleeve 134 and vice versa. The axial displacement of the indexer sleeve 134 is limited by the indexer pin 132 that is rigidly affixed to the interior wall 118 of the indexer piston chamber 116.

Figure 3:
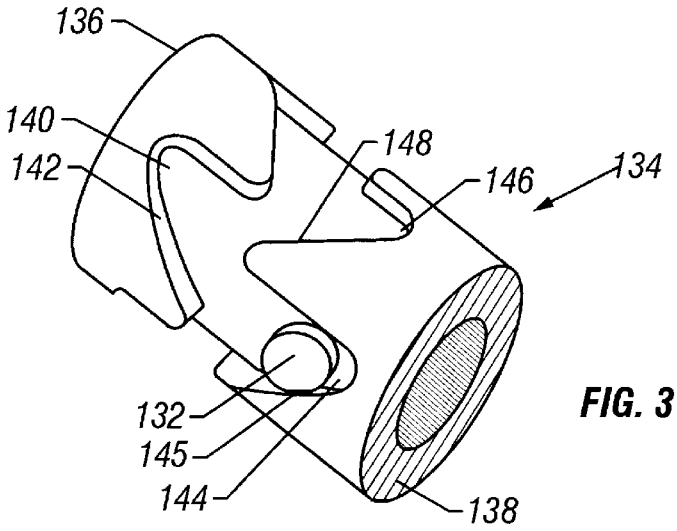
FIG. 3 is a perspective view of an embodiment of the indexer sleeve of the present invention in its lowermost position.
Figure 3A:
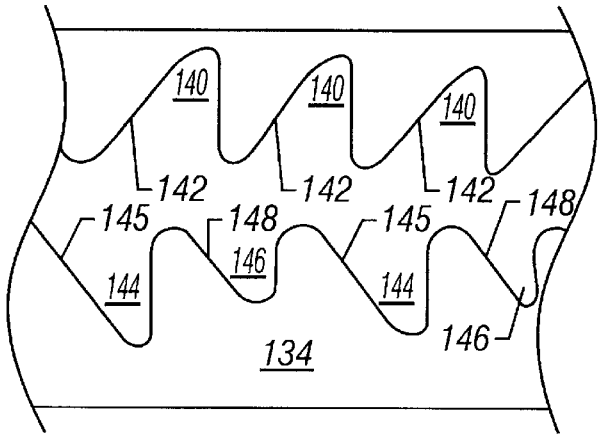
FIG. 3A is a diagrammatic sketch of the receptacles of the indexer sleeve of the present invention.

The axial displacement of the indexer sleeve 134 is best described with reference to FIGS. 3, which is a perspective view of an embodiment of the indexer sleeve 134 of the present invention in its uppermost position, and FIG. 3A which is a diagrammatic sketch displaying the relational positions of the receptacles of the indexer sleeve. As shown in FIG. 3, the indexer sleeve 134 is comprised of an upper thrust surface 136, a lower thrust surface 138, one or more upper stops 140, one or more lower receptacles 144, and one or more intermediate receptacles 146.

In FIG. 3, the indexer pin 132 is located in a lower receptacle 144. In this position, the indexer pin 132 prevents the indexer sleeve 134 from upward movement resulting from a force applied to the lower thrust surface 138. However, upon application of force to the upper thrust surface 136 the indexer sleeve 134 is able to move downward toward its lowermost position. As the indexer sleeve 134 moves downward, the indexer pin 132 is forced into engagement with the tapered surface 142 of an upper stop 140 which forces the indexer sleeve 134 to rotate. The downward travel and rotation of the indexer sleeve 134 continues until the upper stop 140 is engaged by the indexer pin 132. At this point, the indexer sleeve 134 has rotated such that the indexer pin 132 is in axial alignment with the tapered surface 148 of an intermediate receptacle 146.

With the indexer sleeve in its lowermost position in which the indexer pin 132 is engaged by an upper stop 140, a force applied to the lower thrust surface 138 results in the indexer sleeve 134 moving upward toward its uppermost position. As the indexer sleeve 134 moves upward, the tapered surface 148 of an intermediate receptacle 146 engages the indexer pin 132. With continued upward movement, the indexer pin 132 forces the indexer sleeve 134 to rotate as it moves upward. The upward travel and rotation of the indexer sleeve 134 continues until the intermediate receptacle 146 is engaged by the indexer pin 132. At this point, the indexer sleeve 134 is prevented from returning to its uppermost position and is maintained in its intermediate position by the interaction between the indexer pin 132 and the intermediate receptacle 146. Further, the indexer sleeve 134 has rotated such that the indexer pin 132 is in axial alignment with the tapered surface 142 of an upper stop 140.

Alternate applications of force to the upper thrust surface 136 and the lower thrust surface 138 will continue to cause the indexer sleeve 134 to rotate and oscillate between a lowermost, uppermost, and intermediate position.

It should be noted that the positions of travel of the indexer sleeve 134 of this embodiment of the present invention are only demonstrative for a particular application. By altering the receptacle and slot arrangements of the indexer sleeve 134, the indexer sleeve 134 can be oscillated between any number of intermediate positions, or no intermediate positions at all (a simple 2 position indexer sleeve 12). All such embodiments fall within the purview of the present invention.

It should further be noted that in an alternate embodiment, the indexer pin 132 could be located on the control rod 128 with the positional receptacles of the indexer sleeve 134 held stationary within the indexer piston housing 114. Again, such embodiments are intended to fall within the purview of the present invention.

Figure 4:
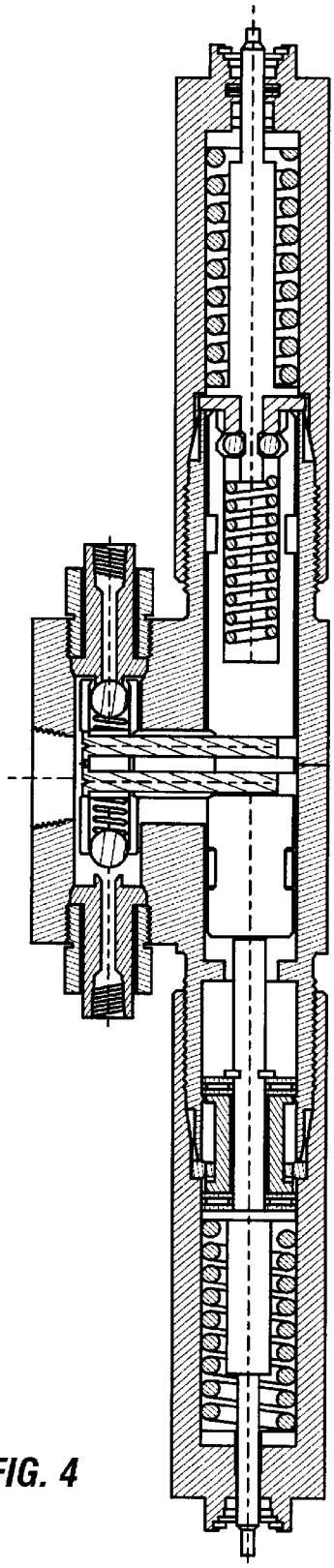
FIG. 4 is a cross-sectional view of an embodiment of the hydraulic distributor of the present invention in its first position under no pressure.

FIGS. 4–9 illustrate the various stages of operation of the hydraulic distributor 1 as it is switched from its first position to its second. FIG. 4 illustrates a cross-sectional view of an embodiment of the hydraulic distributor 1 in its upper position under no pressure. The indexer sleeve 134 in FIG. 4 is in an uppermost position with the indexer pin 132 engaged by a lower receptacle 144. The bias of the indexer spring 130 resists downward movement of the indexer sleeve 134 with the upper movement limited by the interaction between the indexer pin 132 and the lower receptacle 144. Under these conditions, the control rod 128 of the indexer piston 122 contacts the base surface 72 of the shuttle sleeve 60 and forces the shuttle sleeve 60 into its upper position and prevents the shuttle sleeve 60 from downward movement.

Under no pressure, the coefficient of the lock spring 98 is not overcome and so the lock spring 98 continues to maintain the lock piston 88 in its lowermost position in which the flange 92 abuts the fixed cage 100. With the lock piston 88 in its lowermost position, the lock balls 108 remain within the tapered detent 96 of the control rod 94 and the shuttle sleeve 60 is not fixed to the fixed cage 100. However, the downward movement of the shuttle sleeve 60 is restricted by the control rod 128 of the indexer piston 122 as discussed above. Thus, the shuttle sleeve 60 is locked in its upper position.

With the shuttle sleeve 60 in its upper position, the control screws 48, which are affixed to the shuttle sleeve 60, are forced into an upper position within the control chamber 34. Consequently, the supply alternator 36 is forced into its upper position in which the upper actuation ball 38 matingly engages the seating surface 24 of the upper seating element 22. Such engagement is secured by the force supplied by the compression of the upper ball spring 44. The lower actuation ball 38 is maintained within the ball housing 40 by the lower retaining shoulder 42.

Figure 5:
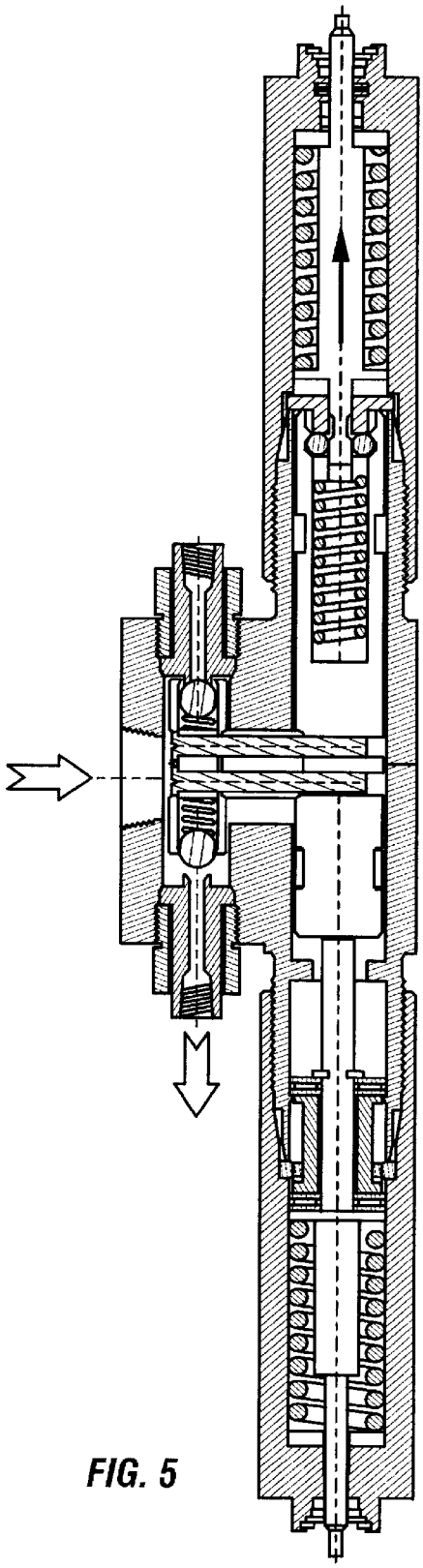
FIG. 5 is a cross-sectional view of an embodiment of the hydraulic distributor of the present invention in its first position under an initial pressure.

The application of an initial pressure to the hydraulic distributor 1 is illustrated in FIG. 5. Under initial pressure, the hydraulic distributor 1 remains in its first position. It should be understood that for purposes of illustration, the term "initial pressure" refers to a pressure sufficient to overcome the spring coefficient of the lock spring 98, but insufficient to overcome the spring coefficient of the indexer spring 130. The coefficients are solely dependent upon the type of application for which the hydraulic distributor 1 is utilized.

As shown in FIG. 5, the hydraulic distributor 1 remains in its first position in which the shuttle sleeve 60 remains in its uppermost position with the indexer pin 132 engaged by a lower receptacle 144. The control rod 128 of the indexer piston 122 maintains the shuttle sleeve 60 in its upper position and resists downward movement of the shuttle sleeve 60.

Under initial pressure conditions, the coefficient of the lock spring 98 is overcome such that the flange 92 applies a force to the lock spring 98 sufficient to compress the lock spring 98 and enable the piston rod 90 to move upward (indicated by the arrow) toward the chamber base 84 of the lock piston chamber 80. The piston rod 90 continues to compress the lock spring 98 until movement of the piston rod 90 is resisted by the chamber base 84. In the embodiment shown in FIG. 5, to protect the surface of the chamber base 84, and to adjust the load of the lock spring 98, a spacer 86 is provided.

As the piston rod 90, and thus control rod 94, moves upward, the lock balls 108 are forced out of the tapered detent 96 and into engagement with the first recess 69*a* of the locking profile 68 of the shuttle sleeve 60. The shuttle sleeve 60 is consequently fixedly engaged to the fixed cage 100 and prevented from downward movement regardless of the position of the control rod 128 of the indexer piston 122.

With the shuttle sleeve 60 remaining in its upper position, the supply alternator 36 is maintained in its upper position in which the upper actuation ball 38 matingly engages the seating surface 24 of the upper seating element 22. The initial pressure is restricted from flow into the upper internal conduit 26 of the upper seating element 22 but is free to flow through the lower internal conduit 26 of the lower seating element 22. Thus, the initial pressure can be used to supply hydraulic fluid pressure to a hydraulic device attached to the lower seating element 22.

It should be understood that the term "restricted" as used herein to describe the control of flow through the upper and lower internal conduits 26 refers to a condition wherein the flow is totally or substantially prevented from entering the conduits 26. As long as a portion of the flow is prevented from entering the conduits 26, the flow is considered to be restricted.

Figure 6:
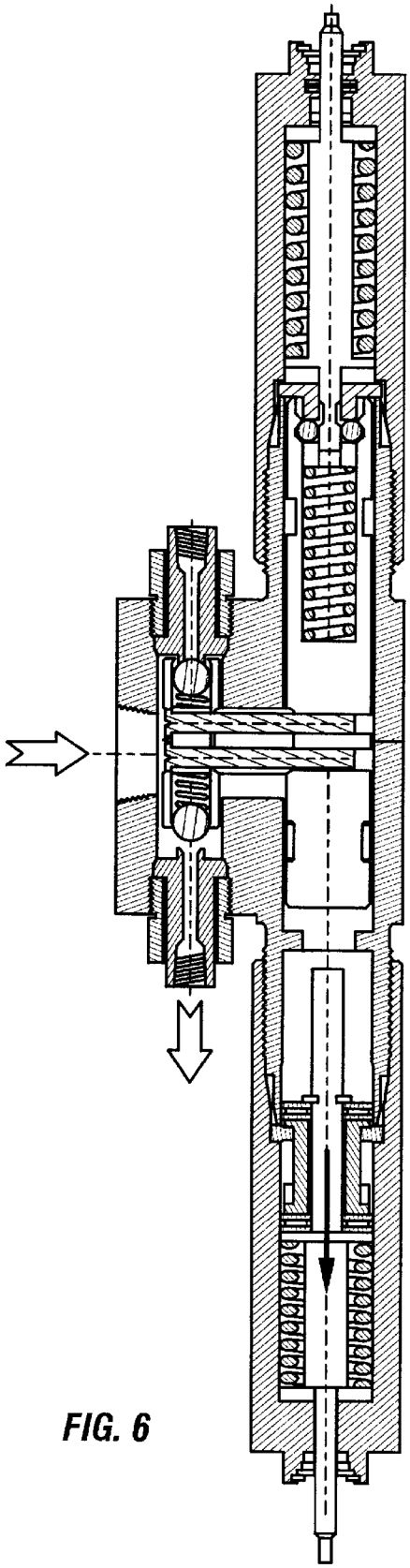
FIG. 6 is a cross-sectional view of an embodiment of the hydraulic distributor of the present invention in its first position under an elevated pressure.

FIG. 6 displays a cross-sectional view of hydraulic distributor 1 as the initial pressure is increased to an elevated pressure. Under this elevated pressure, the hydraulic distributor 1 still remains in its first position. It should be understood that for purposes of illustration, the term "elevated pressure" refers to a pressure sufficient to overcome the spring coefficient of the lock spring 98, and sufficient to overcome the spring coefficient of the indexer spring 130. Again, these coefficients are solely dependent upon the type of application for which the hydraulic distributor 1 is utilized.

As indicated by the arrows in FIG. 6, the coefficient of the indexer spring 130 is overcome such that the flange 126 of the indexer piston 122 applies a force to the indexer spring 130 sufficient to compress the indexer spring 130 and enable the piston rod 124 to move downward toward the chamber base 120. The action of the piston rod 124 forces the indexer sleeve 134 downward toward its lowermost position. As the indexer sleeve 134 moves downward, the indexer pin 132 engages the tapered surface 142 of an upper stop 140 which forces the indexer sleeve 134 to rotate. The downward travel and rotation of the indexer sleeve 134 continues until the upper stop 140 is engaged by the indexer pin 132. At this point, the indexer sleeve 134 has rotated such that the indexer pin 132 is in axial alignment with the tapered surface 148 of an intermediate receptacle 146.

With the upper stop 140 engaged by the indexer pin 132, the indexer sleeve 134 is in its lowest position. Consequently, the control rod 128 is also in its lowest position in which the control rod 128 does not extend above the bore shoulder 58. Thus, the control rod 128 of the indexer piston 122 no longer resists downward movement of the shuttle sleeve 60. However, because the lock piston 88 remains in its upper position with the lock balls 108 of the fixed cage 100 engaged with the recess 69*a* of the shuttle sleeve 60, the shuttle sleeve 60 is maintained in its upper position.

Once again, with the shuttle sleeve 60 remaining in its upper position, the supply alternator 36 is maintained in its upper position in which the elevated pressure is restricted from flow into the internal conduit 26 of the upper seating element 22 but is free to flow through the internal conduit 26 of the lower seating element 22. Thus, the elevated pressure can be used to supply hydraulic fluid pressure to a hydraulic device attached to the lower seating element 22.

Figure 7:
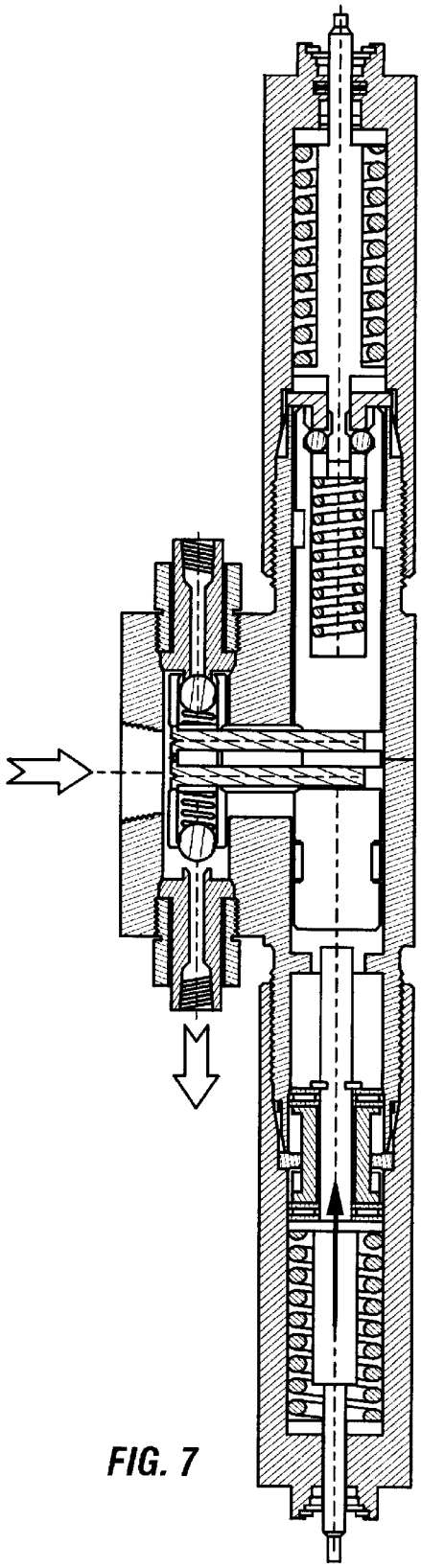
FIG. 7 is a cross-sectional view of an embodiment of the hydraulic distributor of the present invention in its first position with the elevated pressure bled off.

FIG. 7 illustrates the hydraulic distributor 1 with the elevated pressure bled off back to the initial pressure. With the elevated pressure bled off, the hydraulic distributor 1, still remains in its first position.

As indicated by the arrows in FIG. 7, the coefficient of the indexer spring 130 now overcomes the applied pressure such that the indexer spring 130 applies force to the flange 126 of the indexer piston 122 sufficient to force the indexer piston 122 upwards. As the indexer piston 122 moves upwards, the indexer sleeve 134 moves upward toward its uppermost position. As the indexer sleeve 134 moves upward, the tapered surface 148 of an intermediate receptacle engages the indexer pin 132. With continued upward movement, the indexer pin 132 forces the indexer sleeve 134 to rotate as it moves upward. The upward travel and rotation of the indexer sleeve 134 continues until the intermediate receptacle 146 is engaged by the indexer pin 132. At this point, the indexer sleeve 134 is prevented from returning to its uppermost position and is maintained in its intermediate position by the interaction between the indexer pin 132 and the intermediate receptacle 146. Further, the indexer sleeve 134 has rotated such that the indexer pin 132 is in axial alignment with the tapered surface 142 of an upper stop 140. With the indexer sleeve 134 in an intermediate position, the control rod 128 extends up to the bore shoulder 58.

Once again, the lock piston 88 remains in its upper position with the lock balls 108 of the fixed cage 100 engaged with the recess 69*a* of the shuttle sleeve 60, and the shuttle sleeve 60 is maintained in its upper position. Thus, the supply alternator 36 is maintained in its upper position in which the bled off pressure is restricted from flow into the internal conduit 26 of the upper seating element 22 but is free to flow through the internal conduit 26 of the lower seating element 22.

Figure 8:
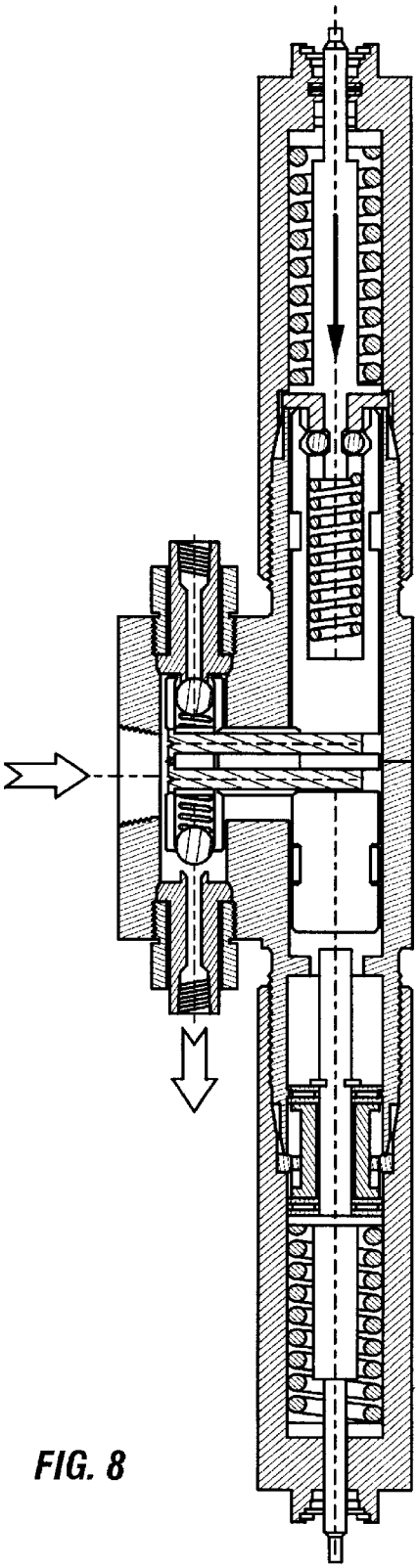
FIG. 8 is a cross-sectional view of an embodiment of the hydraulic distributor of the present invention in its first position with the initial pressure bled off.

FIG. 8 illustrates the hydraulic distributor 1 with the pressure further bled off to a pressure lower than the initial pressure. The hydraulic distributor 1 continues to remain in its first position.

As indicated by the arrows in FIG. 8, the coefficient of the lock spring 98 is no longer overcome and lock spring 98 applies a downward force to the flange 92 such that the piston rod 90 moves downward until the flange 92 abuts and is resisted by the fixed cage 100. As the piston rod 90, and thus the control rod 94, moves downward, the lock balls 108 are once again received in the tapered detent 96 of the control rod 94 and are removed from engagement with the first recess 69*a* of the locking profile 68 of the shuttle sleeve 60. The shuttle sleeve 60 is no longer fixedly engaged to the fixed cage 100. However, the applied pressure maintains the shuttle sleeve 60 in its upward position.

Figure 9:
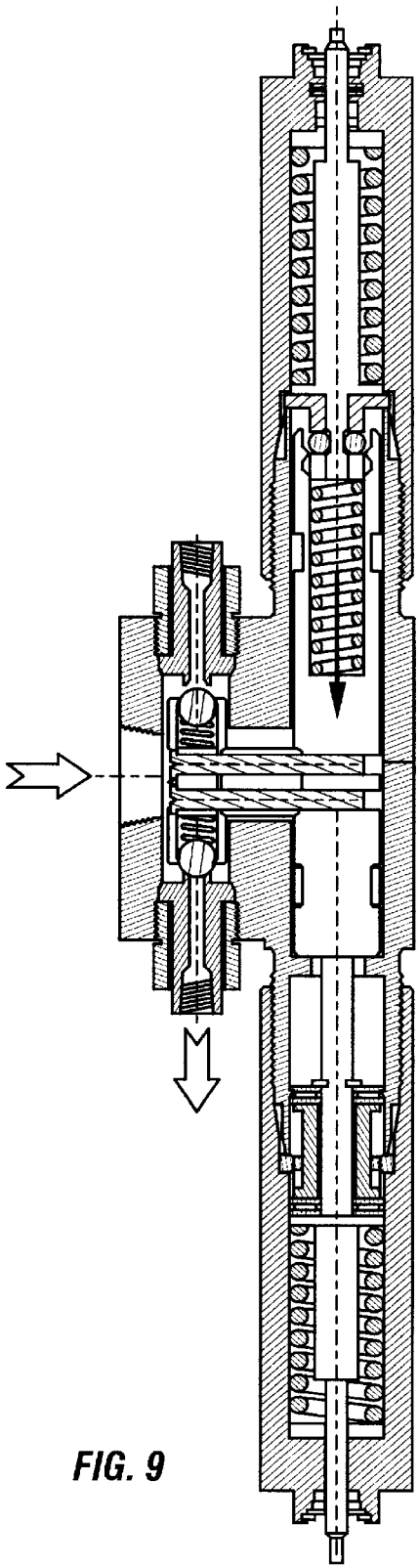
FIG. 9 is a cross-sectional view of an embodiment of the hydraulic distributor of the present invention transitioning to its second position under no pressure.

FIG. 9 illustrates the subsequent bleeding off of the pressure applied to the hydraulic distributor 1 to a predetermined release pressure. Under the release pressure, the hydraulic distributor 1, as indicated by the arrows, moves to its second position.

As stated above with reference to FIG. 8, the shuttle sleeve 60 is no longer held in an upper position by engagement of the lock balls 108 of the fixed cage 100. Thus, once all of the pressure is bled to a predetermined release pressure, the shuttle sleeve 60 is forced to its lower position by action of the shuttle sleeve spring 64, that has a coefficient sufficiently low to be overcome by minimal pressures but able to overcome a no-pressure state. As indicated above, the downward movement of the shuttle sleeve 60 is no longer impeded by the control rod 128 of the indexer piston 122, as it is held in an intermediate position by the engagement of the indexer sleeve 134 by the indexer pin 132.

As the shuttle sleeve 60 moves into its lower position, the control screws 48, which are affixed to the shuttle sleeve 60, are forced into a lower position within the control chamber 34. Consequently, the supply alternator 36 is forced into its lower position in which the lower actuation ball 38 matingly engages the seating surface 24 of the lower seating element 22. Such engagement is secured by the force supplied by the compression of the lower ball spring 44. The upper ball 38 is maintained within the ball housing 40 by the upper retaining shoulder 42.

As has been discussed, the shuttle sleeve spring 64 has a sufficiently low coefficient that the switching of the shuttle sleeve 60 from its upper position to its lower position does not occur until nearly all of the pressure has been bled off. In essence, the action of the shuttle sleeve spring 64 acts to impart a time delay on the switching of the hydraulic distributor 1 from its first position to its second position. This time delay avoids problems associated with prematurely bleeding off the pressure as the supply alternator 36 is toggled from its upper position to its lower position. In addition to affecting the operation of the hydraulic distributor 1, premature bleeding off of the pressure affects the instantaneous delivery of power to the hydraulic devices.

Figure 10:
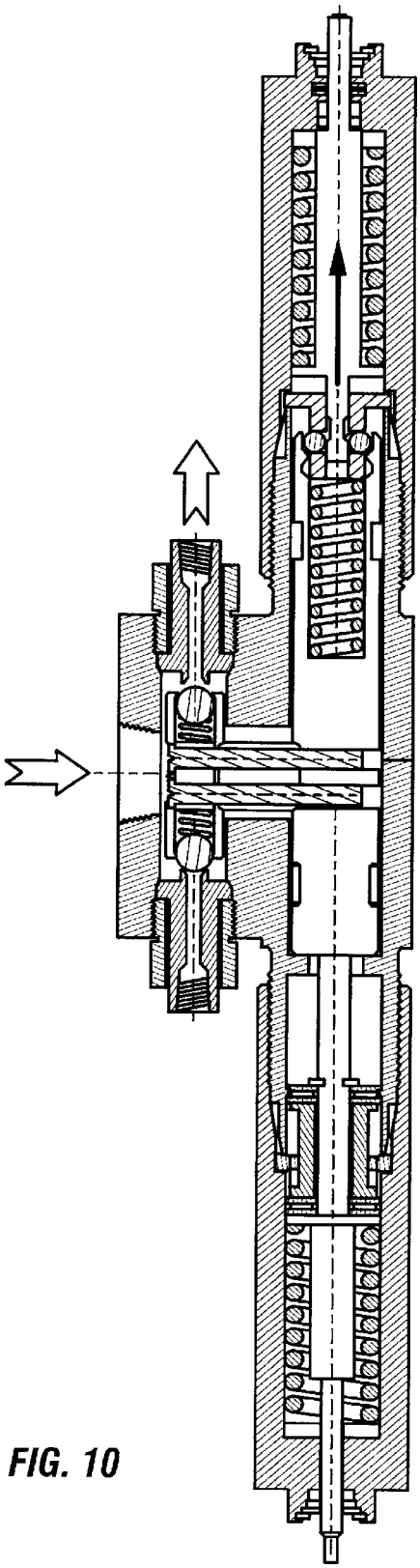
FIG. 10 is a cross-sectional view of an embodiment of the hydraulic distributor of the present invention in its second position under an initial pressure.

FIGS. 10–13 illustrate the various stages of the hydraulic distributor 1 of the present invention as it moves from its second position to its first position. To begin, FIG. 10 provides a cross-sectional view of the hydraulic distributor 1 in its second position under an initial pressure. As discussed above, an intermediate receptacle 146 of the indexer sleeve 134 is engaged by the indexer pin 132. The indexer sleeve 134 is maintained in this position by the bias of the indexer spring 130. As discussed above, force applied to the lower thrust surface 138 is resisted by the interaction between the indexer pin 132 and the intermediate receptacle 146. In this position, the control rod 128 of the indexer piston 122 does not force the shuttle sleeve 60 away from the bore shoulder 58 and away from its lower position.

Under initial pressure, the hydraulic distributor 1 remains in its second position. Again it should be understood that for purposes of illustration, the term "initial pressure" refers to a pressure sufficient to overcome the spring coefficient of the lock spring 98, but insufficient to overcome the spring coefficient of the indexer spring 130.

Under these initial pressure conditions, the coefficient of the lock spring 98 is overcome such that the flange 92 applies a force to the lock spring 98 sufficient to compress the lock spring 98 and enable the piston rod 90 to move upward (indicated by the arrow) toward the chamber base 84 of the lock piston chamber 80. The piston rod 90 continues to compress the spring until its shoulder 87*b* abuts the chamber base 84 preventing further movement. In the embodiment shown in FIG. 10, to protect the surface of the chamber base 84, and to adjust the load of the lock spring 98, a spacer 121 is provided. As the piston rod 90, and thus control rod 94, moves upward, the lock balls 108 are forced out of the tapered detent 96 and into engagement with the second recess 69*b* of the locking profile 68 of the shuttle sleeve 60. The shuttle sleeve 60 is consequently fixedly engaged to the fixed cage 100 and prevented from upward movement.

With the shuttle sleeve 60 fixed in its lower position, the supply alternator 36 is maintained in its lower position in which the lower actuation ball 38 matingly engages the seating surface 24 of the lower seating element 22. The initial pressure is restricted from flow into the lower internal conduit 26 of the lower seating element 22 but is free to flow through the internal conduit 26 of the upper seating element 22. Thus, the initial pressure can be used to supply hydraulic fluid pressure to a hydraulic device attached to the upper seating element 22.

Figure 11:
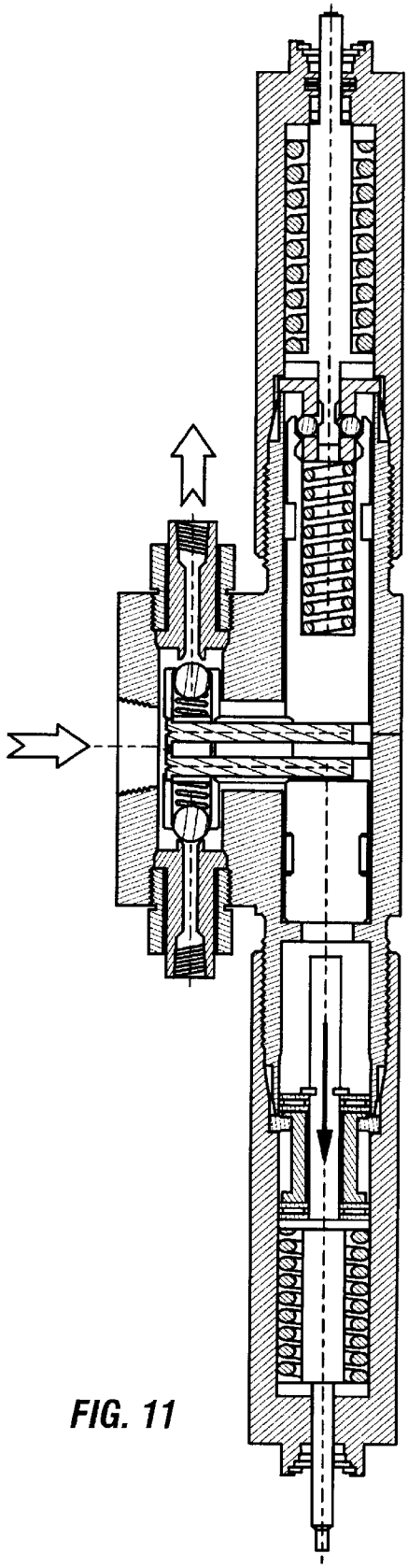
FIG. 11 is a cross-sectional view of an embodiment of the hydraulic distributor of the present invention in its second position under an elevated pressure.

FIG. 11 displays a cross-sectional view of hydraulic distributor 1 as the initial pressure is increased to an elevated pressure. Under this elevated pressure, the hydraulic distributor 1 still remains in its second position. As above, it should be understood that for purposes of illustration, the term "elevated pressure" refers to a pressure sufficient to overcome the spring coefficient of the lock spring 98, and sufficient to overcome the spring coefficient of the indexer spring 130.

As indicated by the arrows in FIG. 11, the coefficient of the indexer spring 130 is overcome such that the flange 126 of the indexer piston 122 applies a force to the indexer spring 130 sufficient to compress the indexer spring 130 and enable the piston rod 124 to move downward toward the chamber base 120. The action of the piston rod 124 forces the indexer sleeve 134 downward toward its lowermost position. As the indexer sleeve 134 moves downward, the indexer pin 132 engages the tapered surface 142 of an upper stop 140 which forces the indexer sleeve 134 to rotate. The downward travel and rotation of the indexer sleeve 134 continues until an upper stop 140 is engaged by the indexer pin 132. At this point, the indexer sleeve 134 has rotated such that the indexer pin 132 is in axial alignment with the tapered surface 145 of a lower receptacle 144.

The shuttle sleeve 60 continues to be maintained in its lower position by the lock balls 108 engaging the second recess 69*b* of the shuttle sleeve. Thus, the supply alternator 36 is maintained in its lower position in which the elevated pressure is restricted from flow into the internal conduit 26 of the lower seating element 22 but is free to flow through the internal conduit 26 of the upper seating element 22. Thus, the elevated pressure can be used to supply hydraulic fluid pressure to a hydraulic device attached to the upper seating element 22.

Figure 12:
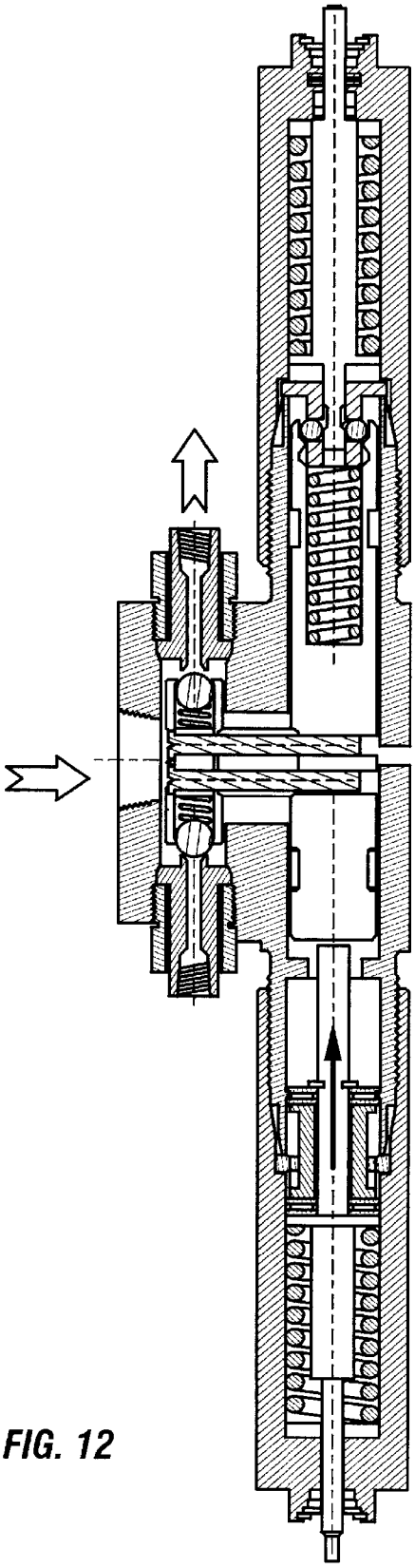
FIG. 12 is a cross-sectional view of an embodiment of the hydraulic distributor of the present invention in its second position with the elevated pressure bled off.

FIG. 12 illustrates the hydraulic distributor 1 with the elevated pressure bled off back to the initial pressure. With the elevated pressure bled off, the hydraulic distributor 1, still remains in its second position. As indicated by the arrows in FIG. 12, the coefficient of the indexer spring 130 now overcomes the applied pressure such that the indexer spring 130 applies force to the flange 126 of the indexer piston 122 sufficient to force the indexer piston 122, and thus the indexer sleeve 134, to move upwards. As the indexer sleeve 134 moves upwards, the tapered surface 145 of a lower receptacle 144 engages the indexer pin 132. With continued upward movement, the indexer pin 132 forces the indexer sleeve 134 to rotate as it moves upward. The upward travel and rotation of the indexer sleeve 134 continues until the control rod 128 of the indexer piston 122 comes into contact with the base surface 72 of the shuttle sleeve 60. Because the shuttle sleeve 60 is locked in its lower position by the lock balls 108 of the fixed cage 100, additional upward movement of the indexer piston 122, and thus indexer sleeve 134, is prevented.

With the shuttle sleeve 60 remaining in its lower position, the supply alternator 36 is also maintained in its lower position in which the bled off pressure is restricted from flow into the internal conduit 26 of the lower seating element 22 but is free to flow through the internal conduit 26 of the upper seating element 22.

Figure 13:
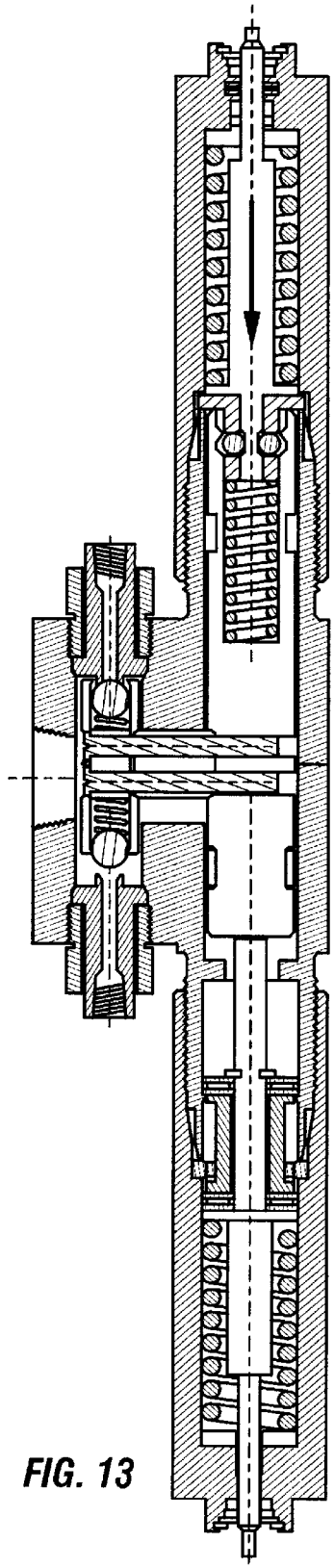
FIG. 13 is a cross-sectional view of an embodiment of the hydraulic distributor of the present invention transitioning to its first position with the initial pressure bled off.

FIG. 13 illustrates the hydraulic distributor 1 with all of the pressure bled off such that the hydraulic distributor 1 returns to its first position. As indicated by the arrows in FIG. 13, the coefficient of the lock spring 98 is no longer overcome and the lock spring 98 applies a downward force to the flange 92 such that the piston rod 90 moves downward until the flange 92 abuts and is resisted by the fixed cage 100. As the piston rod 90, and thus the control rod 94, moves downward, the lock balls 108 are once again received in the tapered detent 96 of the control rod 94 and are removed from engagement with the second recess 69*b* of the locking profile 68 of the shuttle sleeve 60. The shuttle sleeve 60 is no longer fixedly engaged to the fixed cage 100. Now the upward movement of the indexer piston 122 is no longer resisted and the indexer sleeve 134 continues its upward movement until the indexer pin 132 is engaged by the most receptacle 144. At the same time, the control rod 128 forces the shuttle sleeve 60 into and maintains the shuttle sleeve 60 in its upper position.

As the shuttle sleeve 60 moves into its upper position, the control screws 48, which are affixed to the shuttle sleeve 60, are forced into an upper position within the control chamber 34. Consequently, the supply alternator 36 is forced into its upper position in which the upper actuation ball 38 matingly engages the seating surface 24 of the upper seating element 22. Such engagement is secured by the force supplied by the compression of the upper ball spring 44. The lower actuation ball 38 is now maintained within the ball housing 40 by the upper retaining shoulder 42.

Figure 14:
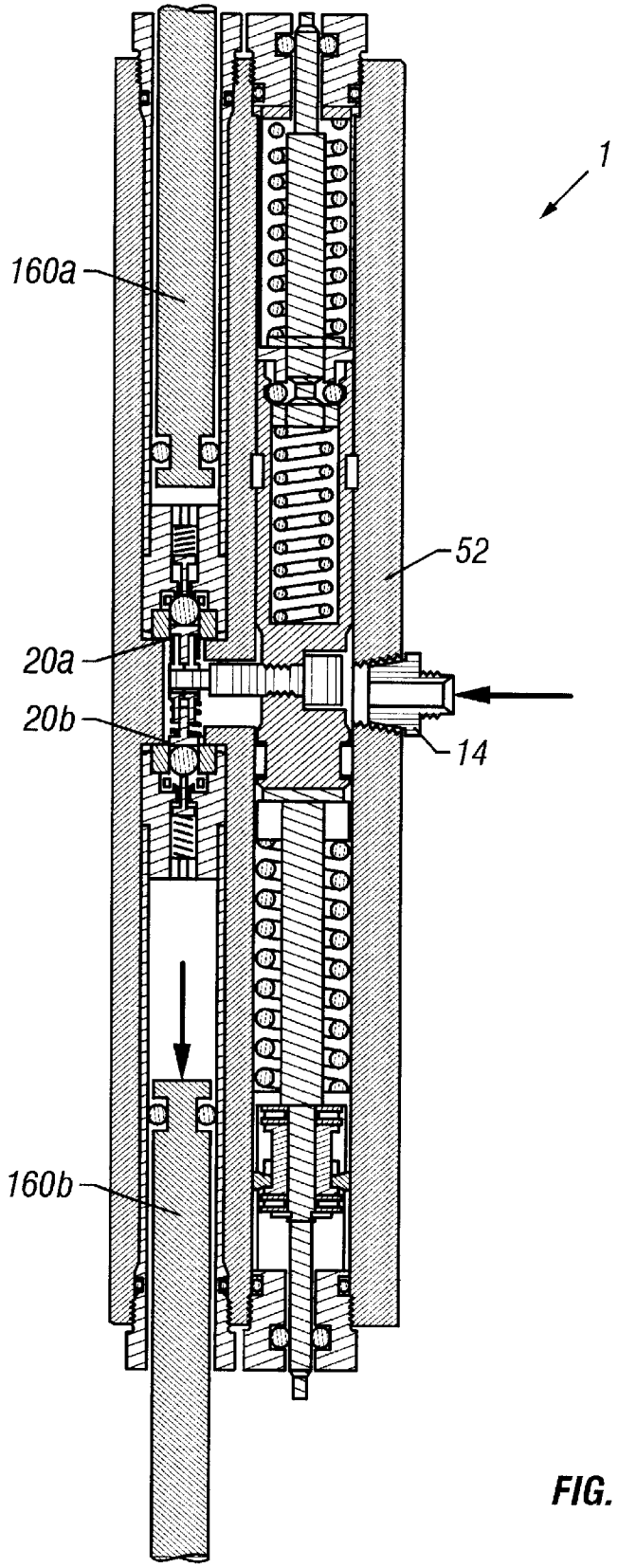
FIG. 14 is a sectional view of an embodiment of the present invention in which hydraulic fluid pressure is distributed to upper and lower pistons.

FIG. 14 provides a sectional view of an embodiment of the present invention in which the outlet ports 20*a*, 20*b* of the hydraulic distributor 1 distribute hydraulic fluid pressure to upper and lower pistons 160*a*, 160*b*. (Again, it should be emphasized that the directional terms such as "up", "down", "upper", "lower", are used to facilitate discussion of the example and are not intended to limit the scope of the present invention.) The upper and lower pistons 160*a*, 160*b* can be used to advantage to control the actuation of various downhole well equipment and tools. In an alternate embodiment, the upper and lower pistons 160*a*, 160*b* are replaced by hydraulic control lines. It should be noted that in this embodiment, the inlet port 14 of the hydraulic distributor 1 is located in the actuator housing 52.

Figure 15:
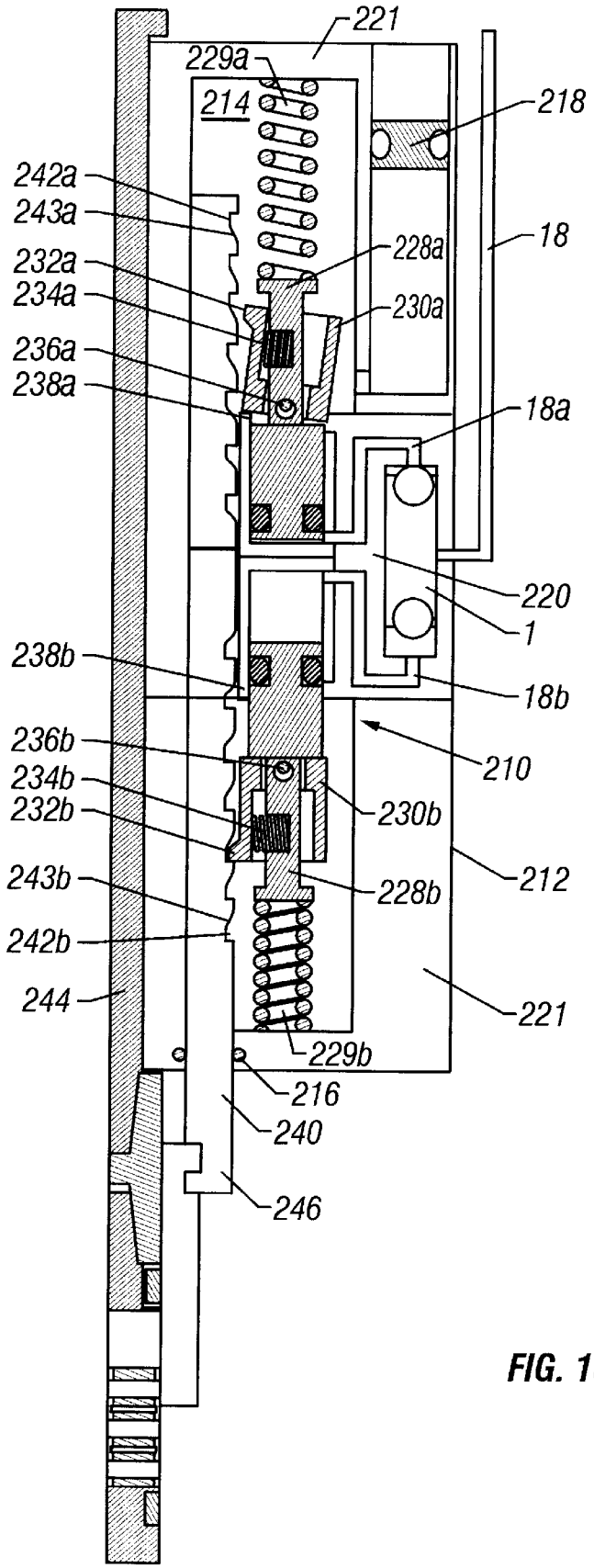
FIG. 15 is a diagrammatic sketch of an embodiment of the present invention wherein the hydraulic distributor further comprises a ratchet assembly.

FIG. 15 is a diagrammatic sketch of an embodiment of the present invention wherein the hydraulic distributor 1 further comprises a ratchet assembly 210. The ratchet assembly 210 is comprised of an upper piston 226*a*, a lower piston 226*b*, and a driving rod 240. The action of the pistons 226*a*, 226*b* is used to incrementally advance or retrieve the driving rod 240 to activate or maneuver downhole tools, devices and equipment. It should be understood that the ratchet assembly 210 of the present invention can be used to manipulate and maneuver a plurality of pistons 226*a*, 226*b* and a plurality of driving rods 240.

The pistons 226*a*, 226*b* of the present invention are actuated by hydraulic fluid pressure supplied by the hydraulic distributor 1. Upper and lower piston springs 229*a*, 229*b* act to return the pistons 226*a*, 226*b* to their initial position once the pressure is bled off. Each of the pistons 226*a*, 226*b* has a control arm 228*a*, 228*b* and a pawl 230*a*, 230*b* having engagement teeth 232*a*, 232*b* attached thereto. In an embodiment of the present invention, the pawls 230*a*, 230*b* are attached to the control arms 228*a*, 228*b* by pins 236*a*, 236*b*, for example, such that the pawls 230*a*, 230*b* have some rotational flexibility, but are substantially rigid in the axial direction of the control arms 228*a*, 228*b*. Engagement springs 234*a*, 234*b* bias the pawls 230*a*, 230*b* such that the engagement teeth 232*a*, 232*b* are forced to rotate away from the control arms 228*a*, 228*b*.

It should be noted that the pawls 230*a*, 230*b* described with reference to the embodiment of the present invention illustrated in FIG. 15 are illustrative and not intended as limiting on the scope of the present invention. Any number of pawls, collet fingers, latching mechanisms, or the like, can be used to advantage to cooperate with the pistons 226*a*, 226*b* and driving rod 240 of the present invention.

A biasing surface 238*a*, 238*b* is located approximate each of the pistons 226*a*, 226*b*. Upon retraction of the pistons 226*a* 226*b*, the pawls 230*a*, 230*b* contact the biasing surface 238*a*, 238*b* which imparts a force upon the pawls 230*a*, 230*b* sufficient to overcome the bias of the engagement springs 234*a*, 234*b* and force the engagement teeth 232*a*, 232*b* to rotate toward the control arms 228*a*, 228*b*.

The driving rod 240 has a plurality of upper ratchet detents 242*a* and lower ratchet detents 242*b* with each ratchet detent 242*a*, 242*b* having a tapered release 243*a*, 243*b*. The ratchet detents 242*a*, 242*b* are oriented such that the upper detents 242*a* can be cooperatively engaged by the upper engagement teeth 232*a* on the upper pawl 230*a*, and likewise, such that the lower detents 242*b* can be cooperatively engaged by the lower engagement teeth 232*b* on the lower pawl 230*b*. The cooperative engagement enables the driving rod 240 to be incrementally advanced or retrieved. The spacing and number of ratchet detents 242*a*, 242*b* is dependent upon the application for which the present invention is being used.

In an embodiment of the present invention, the hydraulic distributor 1, and the ratchet assembly 210 are housed within an assembly frame 212 that is affixed to pipe tubing 244, for example. The assembly frame 212 has a hydraulic module 220 that houses the hydraulic distributor 1 and the upper and lower pistons 226*a*, 226*b*. The assembly frame 212 also has opposing spring modules 221 that, in combination with the hydraulic module 220, form a compression chamber 214 filled with a fluid such as oil. The control arms 228*a*, 228*b* of the pistons 226*a*, 226*b* extend therein the compression chamber 214, and the piston springs 239*a*, 239*b* are housed within the compression chamber 214. The driving rod 240 is maneuverable within the compression chamber 214 and the lower end of the driving rod 240 extends therethrough the compression chamber 214 such that the device coupling 246 located at the distal end of the driving rod 240 can be used to advantage to control downhole tools, devices, and equipment.

A compensating piston 218 is located within the assembly frame 212 that acts to maintain the fluid pressure within the compression chamber 214 equal to the external bore pressure. Maintaining equal internal and external pressure provides several advantages. One such advantage is to maintain the fluid seals 216 that act to keep the compression chamber 214 free from contaminants, such as sand, that tend to degrade the components of the ratchet assembly 210. An additional advantage of using the compensating piston 218 to maintain equal internal and external pressure is to prevent the piston effect of the rod 240. If, for example, the external bore pressure is higher than the internal pressure of the compression chamber 214, absent a high enough countering force supplied by the lower piston 226*b*, the driving rod 240 will be forced upwards which could act to prematurely activate or deactivate a downhole device or tool. Likewise, an internal pressure of the compression chamber 214 greater than the external bore pressure acts to force the driving rod 240 downwards. Thus, to maintain control over the maneuvering of the driving rod 240 it is necessary to maintain equal internal and external pressures.

In operation, hydraulic fluid pressure is supplied by the main control line 18 to the hydraulic distributor 1. In the sketch shown in FIG. 15, the hydraulic distributor 1 is in its second position in which hydraulic fluid flow travels through the second flow line 18*b* to actuate the lower piston 226*b* and force the pawl 238*b* downward. As discussed above, the engagement teeth 232*b* are biased away from the control arm 228*b* and engage a lower ratchet detent 242*b* of the driving rod 240. Thus, downward movement of the control arm 228*b* acts to force the driving rod 240 downward.

Under continued hydraulic pressure, the control arm 228*b* of the lower piston 226*b* continues to move downward until it reaches its maximum stroke. At this point, if it is desired to advance the driving rod 240 further, the pressure through the supply line 18*b* is bled off until the lower piston spring 233*b* forces the piston 226*b* back to its retracted position. As the piston 226*b* and control arm 228*b* are forced back toward its retracted position, the engagement teeth 232*b* are guided out of engagement with the lower ratchet detent 242*b* of the driving rod 240 by its tapered release 243*b*. Subsequent supply of hydraulic pressure through the supply line 18*b* acts to again force the lower piston 226*b* and pawl 238*b* downward. Because the engagement spring 234*b* keeps the engagement teeth 232*b* in contact with the profile of the driving rod 240, the engagement teeth 232*b* are forced into engagement with another ratchet detent 242*b* of the driving rod. The newly engaged ratchet detent 242*b* is displaced on the driving rod 240 above the first ratchet detent 242*b* at a distance approximating the stroke of the piston 226*b*. Under continued hydraulic pressure, the control arm 228*b*, and therefore driving rod 240, are forced downward until the piston 226*b* reaches its maximum stroke. Cycling the above sequence of events acts to maneuver the driving rod 240 through its full displacement.

While the driving rod 240 is being forced downward, there is no hydraulic fluid pressure supplied by the hydraulic distributor 1 to the upper piston 226*a*. As such, the upper piston spring 239*a* forces the upper piston 226*a* into its fully retracted position. As the control arm 238*a* is retracted by the piston 226*a*, the pawl 230*a* contacts the biasing surface 238*a*. Because the force supplied by the upper piston spring 239*a* is greater than the force supplied by the engagement spring 234*b*, the engagement teeth 232*a* are forced out of contact with the driving rod 240. Thus, the driving rod 240 can be maneuvered downward without any frictional resistance provided by the upper pawl 230*a*.

To reverse the process and move the driving rod 240 upwards, the hydraulic fluid pressure supplied by the main control line 18 is varied to exceed predetermined switching parameters of the hydraulic distributor 1 to switch the hydraulic distributor 1 to its second position. In its second position, the hydraulic distributor supplies hydraulic fluid pressure to the first supply line 18*a*. The upper piston 226*a* is now actuated and as it is forced upward, the engagement spring 234*a* forces the engagement teeth 232*a* of the pawl 230*a* into engagement with the ratchet detents 242*a* of the driving rod 240. As above, repeated supply and bleeding off of the hydraulic fluid pressure to the upper piston 226*a* acts to incrementally advance the driving rod 240 in an upward direction.

Because the driving rod 240 is advanced and retrieved by the actions of the pistons 226*a*, 226*b*, directional movement in both directions is controlled by positive pressure supplied from the hydraulic distributor 1. Thus, neither direction of movement of the driving rod 240 is controlled by a spring. As a consequence, the ratchet assembly 210 enables more powerful movement of the driving rod 240 in both directions. This enables the ratchet assembly 210 to be used to advantage on tools, devices, and equipment requiring equal activation and deactivation forces. Further, such activation and deactivation is achieved from a single control line 18. The use of the small strokes to advance or retrieve the driving rod 240 offers many advantages. One such advantage is to enable incremental movement of the driving rod 240. Such incremental movement offers advantages to various downhole tools, devices, and equipment. For example, if the ratchet assembly 210 is used to control a valve, the incremental movement enables the valve to be opened or closed at varying rates of speed. Additionally, the valve can be maintained in many intermediate positions in which the valve is partially opened or closed.

Another advantage of the small strokes that may be, but not required to be, utilized by the ratchet assembly 210 of the present invention is that a long stroke of the pistons 226*a*, 226*b* is achieved by the use of many smaller strokes. Using smaller strokes enables the use of relatively compact but powerful mechanical piston springs 239*a*, 239*b*. This avoids the problems associated with using longer mechanical springs (i.e., loss of resistivity) for pistons having a longer stroke.

Another advantage of the ratchet assembly 210 is that it can be used to force the driving rod 240 forward and backward without having to cycle through the complete stroke of the pistons 226*a*, 226*b* like that required with the use of conventional j-slot designs.

Figure 15A:
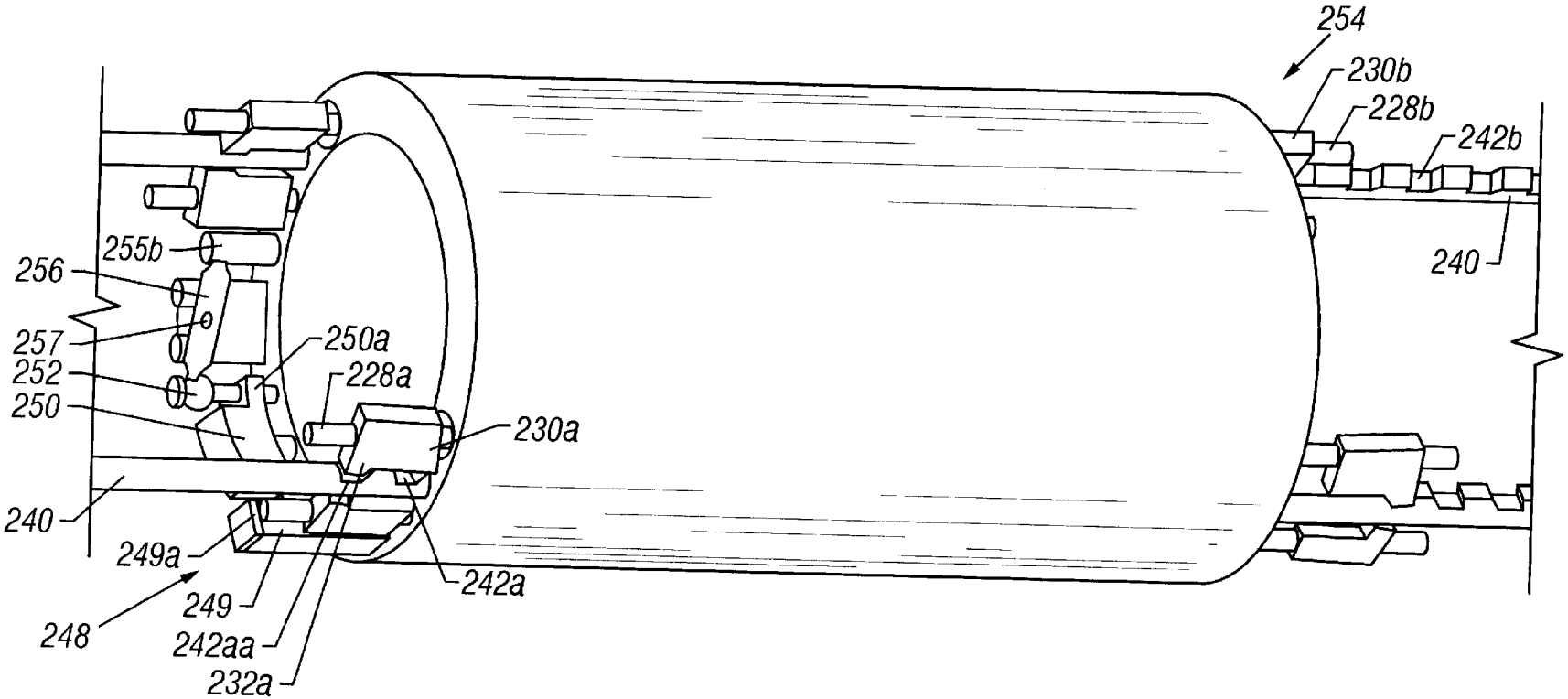
FIG. 15A is a perspective view an embodiment of the present invention wherein the ratchet assembly further comprises a mechanical override.
Figure 15B:
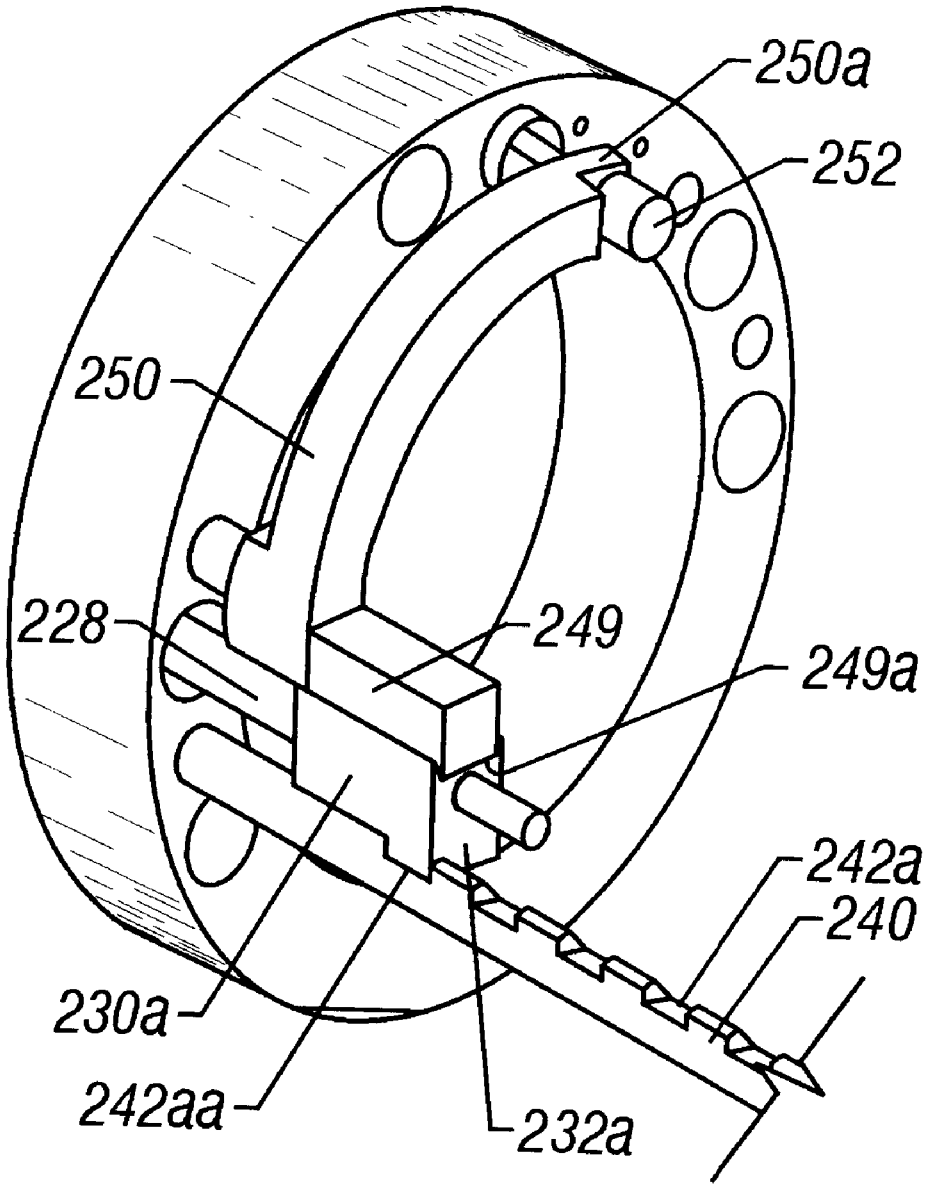
FIG. 15B is a perspective view of the proximal components of an embodiment of the mechanical override.
Figure 15C:
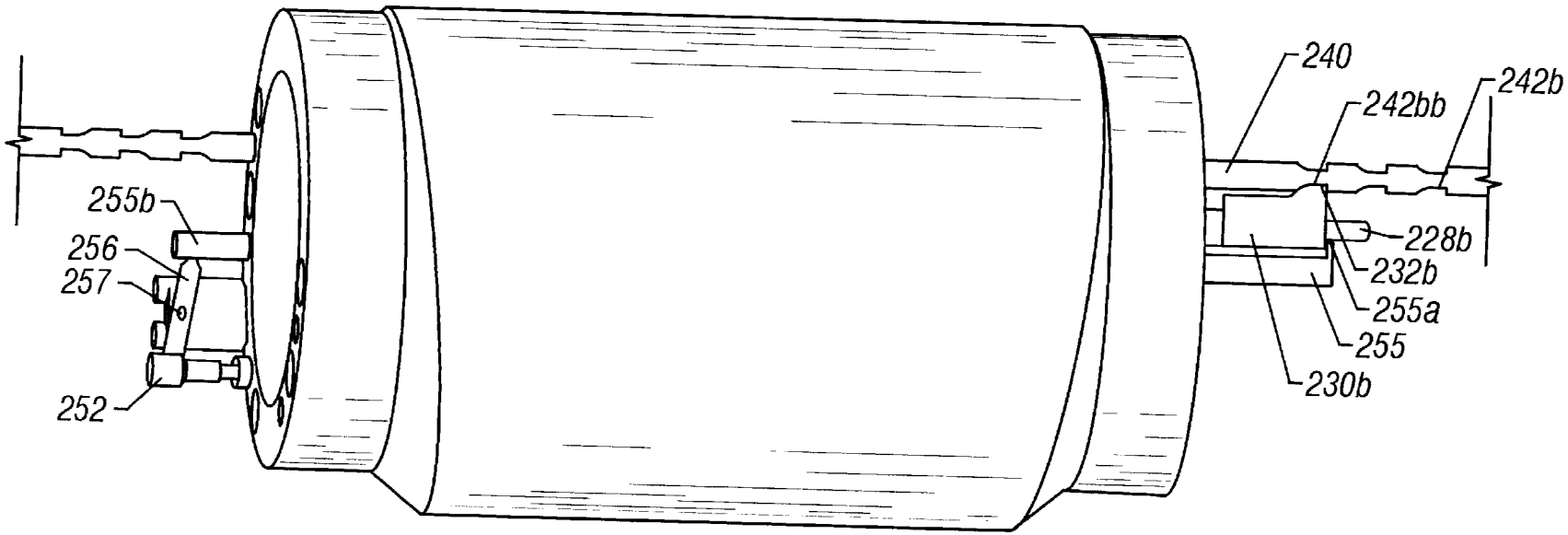
FIG. 15C is a perspective view of the distal components of an embodiment of the mechanical override.

In an embodiment shown in FIGS. 15A–15C, a mechanical override is provided. The mechanical override acts to mechanically switch the hydraulic distributor 1 from its first position to its second position, or from its second position to its first position. The mechanical override is activated when the engagement teeth 232*a*, 232*b* of the pawls 230*a*, 230*b* have been displaced beyond the last ratchet detents 242*aa*, 242*bb* of the driving rods 240 in either direction.

In the embodiment shown in FIGS. 15A–15C, the ratchet assembly 210 is used to control two driving rods 240. The mechanical override is provided with a proximal override 248 that is activated when the engagement teeth 232*a* of the pawls 230*a* have been displaced beyond the last ratchet detents 242*aa* of the proximal end of the driving rods 240. The mechanical override is further provided with a distal override 254 that is activated when the engagement teeth 232*b* of the pawls 230*b* have been displaced beyond the last ratchet detents 242*bb* of the distal end of the driving rods 240. It is important to note that although the mechanical override is described with reference to the embodiment shown in FIGS. 15A–15C in which two driving rods 240 are controlled, the mechanical override is not so limited. The mechanical override of the present invention has equal applicability to ratchet assemblies 210 used to control any number of driving rods 240.

The proximal override 248 is best described with reference to FIGS. 15A and 15B. The proximal override 248 has a proximal lifter 249 having a proximal lifter notch 249*a*. Under normal operating conditions, with the engagement teeth 232*a* of the pawls 230*a* engaged in the ratchet detents 242*a* of the driving rods 240, the pawls 230*a* are maneuverable by the piston 228*a* without interference from the proximal lifter notch 249*a*. However, because the last ratchet detents 242*aa* of the driving rods 240 are not cut as deep as the other ratchet detents 242*a*, once the pawls 230*a* engage the last ratchet detents 242*aa*, the proximal lifter notch 249*a* engages the pawls 230*a*. Thus, as indicated by the arrows in FIG. 15B, further outward movement by the piston 228*a*, results in displacement of the proximal lifter 249.

Affixed to the proximal lifter 249 is a lifter arm 250 having a lifting fork 250*a* for engagement and displacement of a distribution trigger 252. Outward displacement by the proximal lifter 249 results in displacement of the lifter arm 250, and consequently, outward displacement of the distribution trigger 252 (as indicated by the arrows in FIG. 15B). Because the distribution trigger 252 is affixed to the piston shaft 90*a* (shown in FIG. 1), outward displacement of the distribution trigger 252 activates the lock piston 90 to mechanically switch the hydraulic distributor 1. Once the hydraulic distributor 1 is switched, the pawls 230*b* can be used to displace the driving rods 240 in the opposite direction, or can be used to bring the pawls 230*a* back into engagement with the driving rods 240.

The distal override 254 is best described with reference to FIGS. 15A and 15C. The distal override 254 has a distal lifter 255 having a distal lifter notch 255*a* and a distal lifter base 255*b*. Under normal operating conditions, with the engagement teeth 232*b* of the pawls 230*b* engaged in the ratchet detents 242*b*, the pawls 230*b* are maneuverable by the piston 228*b* without interference from the distal lifter notch 255*a*. However, because the last ratchet detents 242*bb* of the driving rod 240*b* are not cut as deep as the other ratchet detents 242*b*, once the pawls 230*b* engage the last ratchet detents 242*bb*, the distal lifter notch 255*a* engages the pawls 230*b*. Thus, as indicated by the arrows in FIG. 15B, further outward movement by the piston 228*b*, results in displacement of the distal lifter 255.

Affixed to the base 255*b* of the distal lifter 249 is a rocker 256 that rotates about a hinge pin 257. The rocker 256 is in engagement with the distribution trigger 252. Outward displacement by the distal lifter 255 results in inward displacement of the distal lifter base 255*b*, and consequently, outward displacement of the distribution trigger 252 (as indicated by the arrows in FIG. 15B). Because the distribution trigger 252 is affixed to the piston shaft 90*a* (shown in FIG. 1), outward displacement of the distribution trigger 252 activates the lock piston 90 to mechanically switch the hydraulic distributor 1. Once the hydraulic distributor 1 is switched, the pawls 230*a* can be used to displace the driving rods 240 in the opposite direction, or can be used to bring the pawls 230*b* back into engagement with the driving rods 240.

In this manner, the mechanical override acts to mechanically switch the hydraulic distributor 1 when the last ratchet detents 242*aa*, 242*bb* have been reached. This enables the controller to know the limit to which the driving rod 240 can be displaced, and eliminates the need to use excessive pressure to switch the hydraulic distributor 1. Depending upon the application, excessive pressures may not be possible.

Figure 15D:
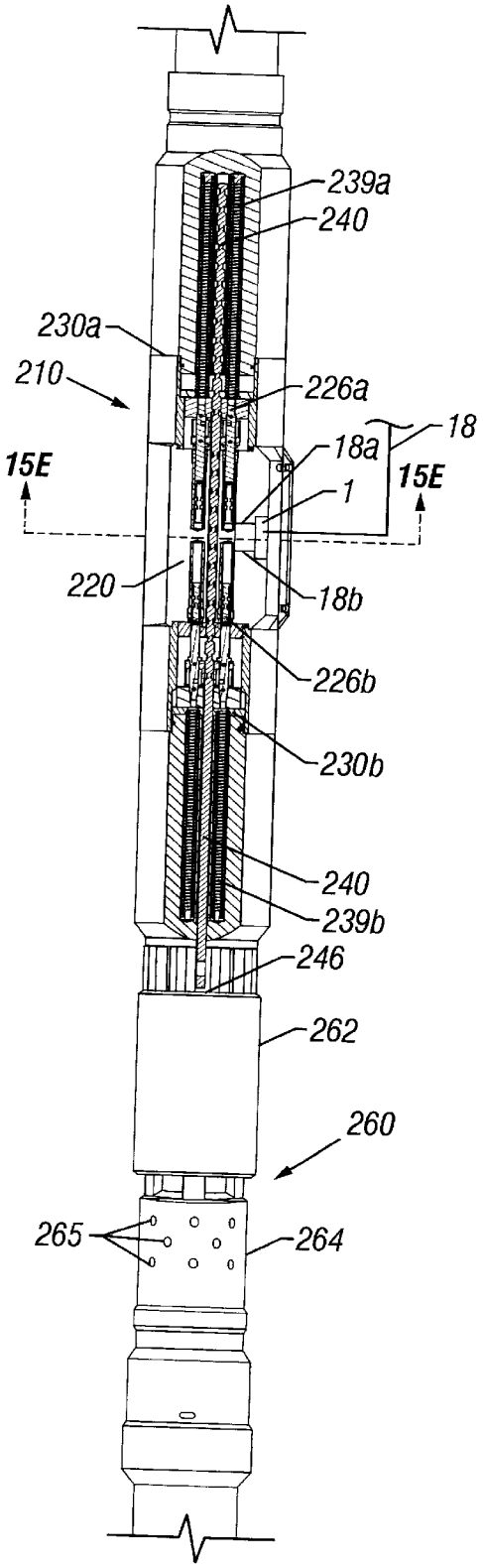
FIGS. 15D and 15E show an embodiment of the present invention used to control a subsurface safety valve.
Figure 15E:
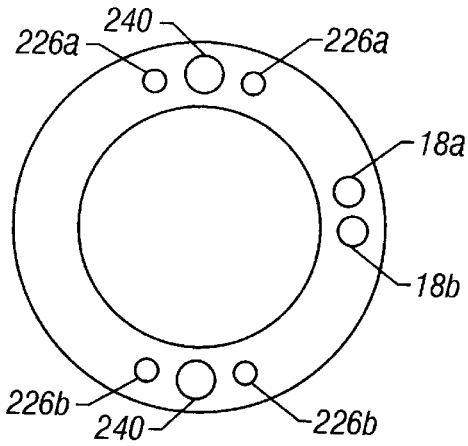

An embodiment of the present invention shown in FIGS. 15D and 15E shows the ratchet assembly 210 used to advantage to control a subsurface safety valve 260. The safety valve 260 has a choke 262 in communication with a flow regulator 264. The flow regulator 264 has multiple intermediate conduits 265 through which flow is enabled. Thus, incremental movement of the choke 262 over the conduits 265 enables precise flow regulation and control. It should be noted that in the embodiment shown in FIGS. 15D and 15E, the ratchet assembly 210 and the hydraulic distributor 1 are mounted in the wall of a well tool such that the wall of the well tool houses both components and acts as the assembly frame 212. It should be further noted that in an alternate embodiment, the components are mounted eccentrically in the well tool wall.

In the embodiment shown in FIGS. 15D and 15E, the ratchet assembly 210 is comprised of two sets of pistons 226*a*, 226*b* used to manipulate two driving rods 240. Again, the number of pistons 226*a*, 226*b* and driving rods 240 can be altered and still remain within the purview of the invention. The driving rods 240 are affixed to the choke 262 of the safety valve 260 by the device coupling 246. As discussed above, by alternating the hydraulic fluid pressure from the main control line 18, the hydraulic distributor 1 is used to manipulate the pistons 226*a*, 226*b* of the ratchet assembly 210, which, in turn, manipulate the driving rods 240. Downward movement of the driving rods 240 acts to force the choke 262 downward to incrementally close the valve 260, and upward movement of the driving rods 240 acts to force the choke 262 upward to incrementally open the valve 260. Thus, the pressure cycles can shift the safety valve 260 to the fully open position, multiple intermediate positions, and the fully closed position. In this manner, incremental opening and closing of the safety valve 260 can be accomplished by varying the flow supplied to a single control line 18.

Figure 15F:
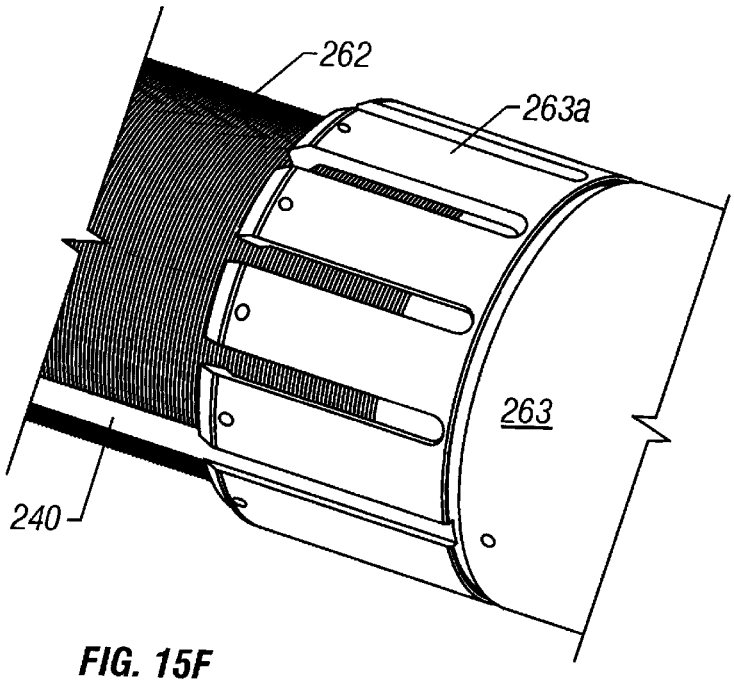
FIG. 15F is a perspective view of an embodiment of an internal brake.

It should be noted that the illustrated embodiment of the choke 262 of the safety valve 260 has an internal brake 263 (shown in FIG. 15F) which acts to prevent undesired upward or downward movement of the choke 262. Such brakes, known in the art, are used to advantage in the present invention to ensure that the driving rods 240, which are affixed to the choke 262 are not able to displace when the hydraulic pressure is released. Although not required, such brakes are particularly advantageous in the present invention wherein it is necessary to bleed off hydraulic pressure to incrementally advance the ratchet assembly 210. The embodiment of an internal brake 263 shown in FIG. 15F is comprised of a series of semi-rigid fingers 263*a* that engage and grip notches cut into the choke 262 to prevent movement of the choke 262 until activation of the driving rod 240. The fingers 263*a* flex enough to enable the choke 262 to displace under force supplied by the driving rod 240, but grip securely upon release of such force. In another embodiment, the internal brake 263 can be applied directly to the driving rod 240.It should be understood that, although in the above discussed embodiments of the present invention the ratchet assembly 210 is manipulated by the hydraulic distributor 1, in an alternate embodiment the ratchet assembly is manipulated independently of the hydraulic distributor 1. For example, the ratchet assembly 210 can be manipulated by hydraulic fluid pressure supplied by a plurality of control lines in direct communication with the pistons 226*a*, 226*b*, or by other known methods.

Figure 16:
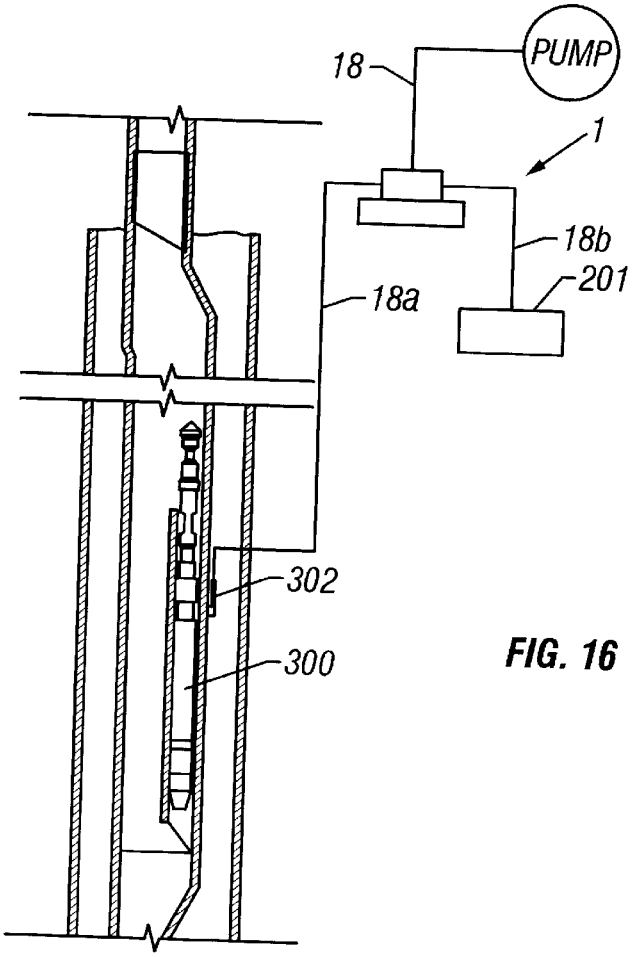
FIG. 16 is a diagrammatic sketch of an embodiment of the present invention wherein the hydraulic distributor is used to control a sliding sleeve valve.

FIG. 16 is a diagrammatic sketch of an embodiment of the present invention wherein the hydraulic distributor 1 is used to advantage to control a sliding sleeve valve 300 such as that disclosed in U.S. Pat. No. 4,524,831 to Pringle. The sliding sleeve valve 300 is moved to an open position by applying pressure to a hydraulic inlet 302 and returned to its closed position by bleeding off the pressure. A spring may also be provided to facilitate the closing of the valve.

In FIG. 16, a hydraulic distributor 1 receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the hydraulic inlet 302 through the first supply line 18*a*. The hydraulic fluid pressure entering the hydraulic inlet 302 actuates the sliding sleeve valve 300 and it is moved to an open position. Bleeding off the pressure from the main control line 18 acts to return the sliding sleeve valve 300 to its closed position. In this manner, repeated opening and closing of the sliding sleeve valve 300 can be accomplished.

An additional hydraulic device 201 can also be actuated by the hydraulic distributor 1. As discussed earlier in describing the operation of the hydraulic distributor 1, by varying the pressure supplied by the main control line 18 to exceed predetermined switching parameters, the hydraulic distributor 1 can be switched from its first position to its second position. In its second position, the hydraulic distributor 1 prevents flow to the first supply line 18*a* while enabling hydraulic fluid pressure to the second supply line 18*b*. In its second position, the hydraulic distributor 1 facilitates hydraulic fluid pressure to an additional hydraulic device 201.

Thus, by varying the hydraulic fluid pressure supplied by the main control line 18, the hydraulic distributor 1 can be used to advantage to supply hydraulic fluid pressure to one or more hydraulic devices. The hydraulic distributor 1 only switches position upon exceeding predetermined pressure values, therefore, the flow to one or the other device can be varied without premature switching of the position of the distributor 1. In this way, individual devices can be oscillated between pressure states and one or more devices can be remotely controlled by a single control line 18.

It should be noted that for discussion purposes, the hydraulic distributor 1 is shown in FIG. 16 as a diagrammatic sketch. The sketch is not intended to limit the location of the hydraulic distributor 1 as being external to the sliding sleeve valve 300. The hydraulic distributor 1 can also be provided on or in a wall of the sliding sleeve valve 300 or be provided on or in a wall of a tool string to which the sliding sleeve valve 300 is a part of, for example.

FIGS. 17A–17D are fragmentary elevational views, in quarter section, of an embodiment of the present invention wherein the hydraulic distributor 1 (shown as a diagrammatic sketch) is used to advantage to control a safety valve 310 such as that disclosed in U.S. Pat. No. 4,621,695 to Pringle. The safety valve 310 is moved to an open position by applying hydraulic pressure to a first hydraulic inlet 311 that is in communication with the upper surface of the piston 312. The safety valve 310 is returned to its closed position by applying a greater hydraulic pressure to a second hydraulic inlet 312 that is in communication with the lower surface of the piston 312.

A hydraulic distributor 1 (shown in FIG. 17A) receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the first hydraulic inlet 311 through the first supply line 18*a*. The hydraulic fluid pressure entering the hydraulic inlet 311 forces the piston 312 downward which acts to open the safety valve 310.

The second supply line 18*b* of the hydraulic distributor 1 is in communication with the second hydraulic inlet 313. Thus, varying the flow from the main control line 18 to switch the hydraulic distributor 1 from its first position to its second position, acts to supply hydraulic fluid pressure to the second hydraulic inlet 313 which forces the piston 312 upward and moves the safety valve 310 to a closed position. In this manner, repeated opening and closing of the sliding safety valve 310 can be accomplished by varying the flow supplied to a single control line 18.

Figures 17A, 17B:
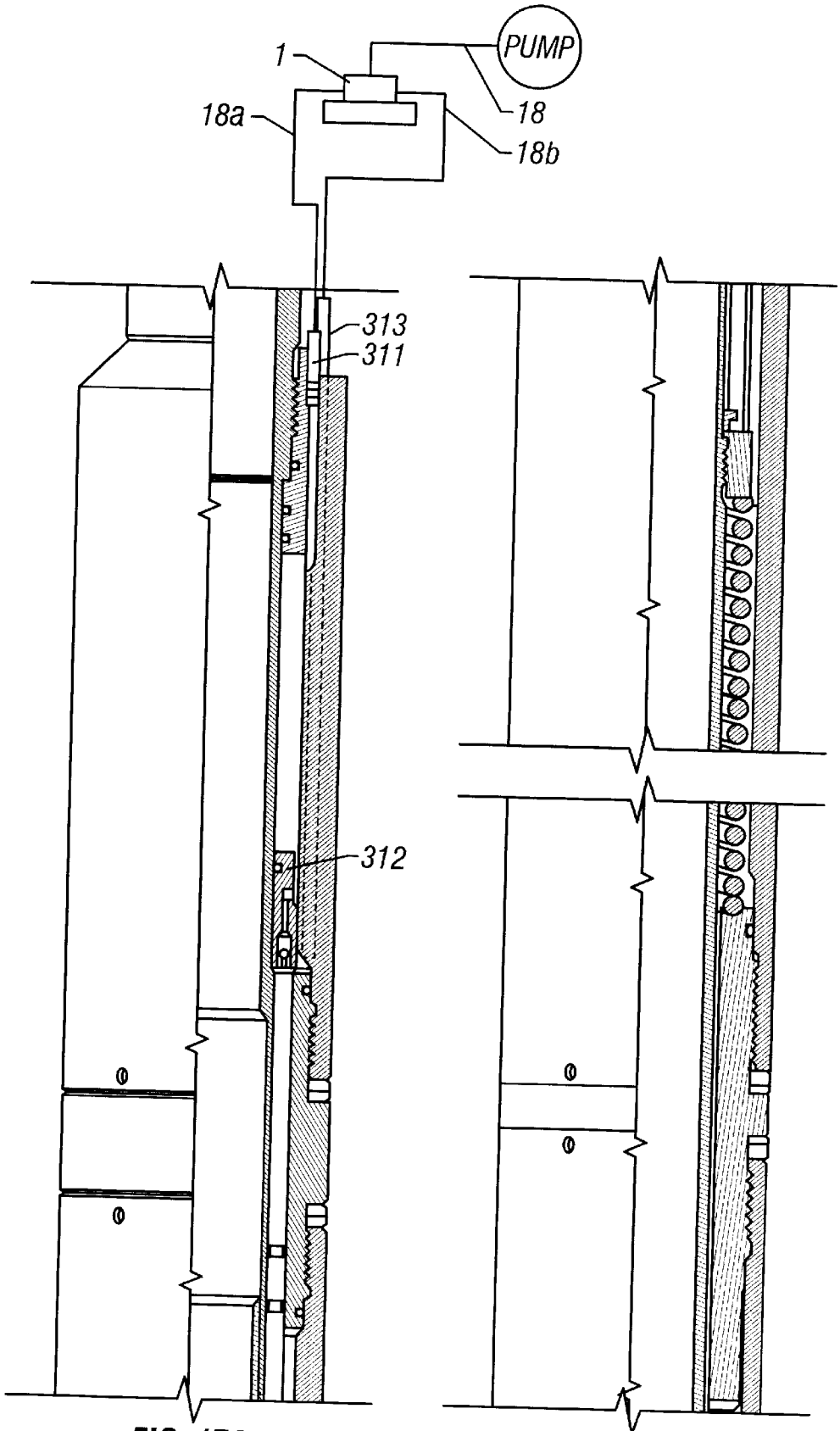
FIGS. 17A–17D are fragmentary elevational views, in quarter section, of an embodiment of the present invention wherein the hydraulic is used to control a safety valve.
Figure 17C:
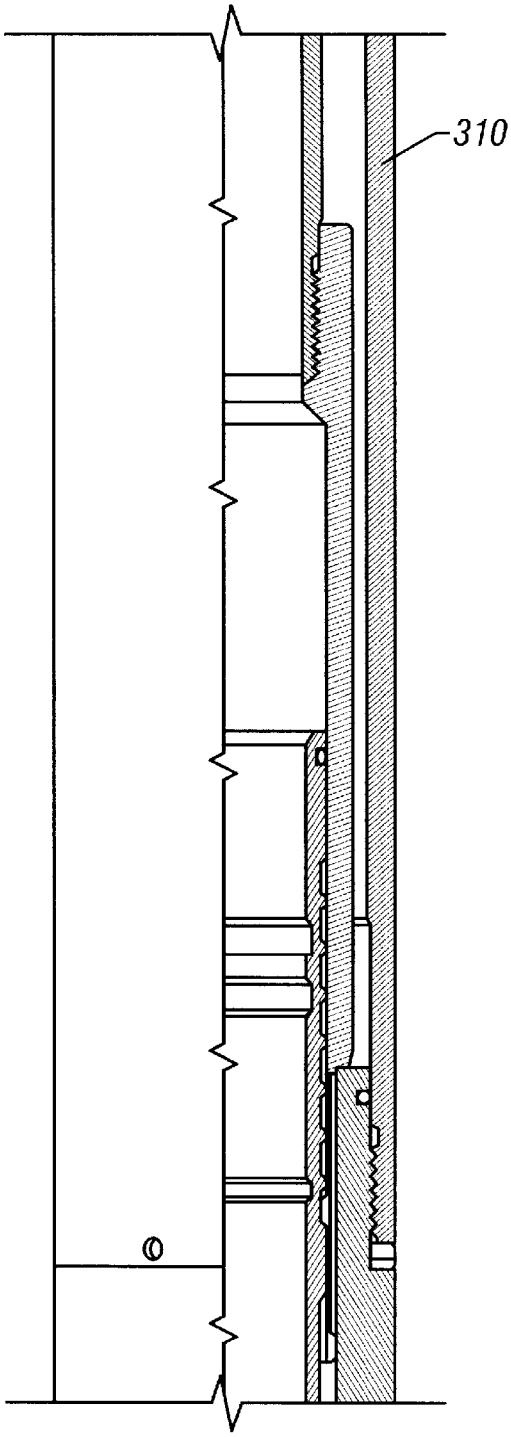
Figure 17D:
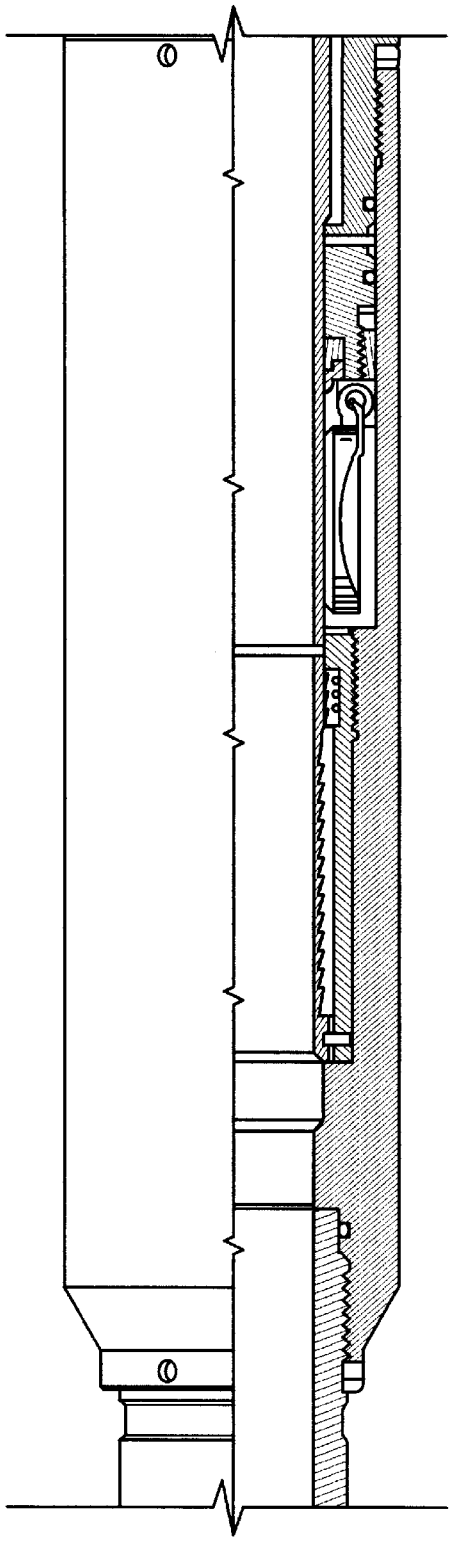
Figure 18A:
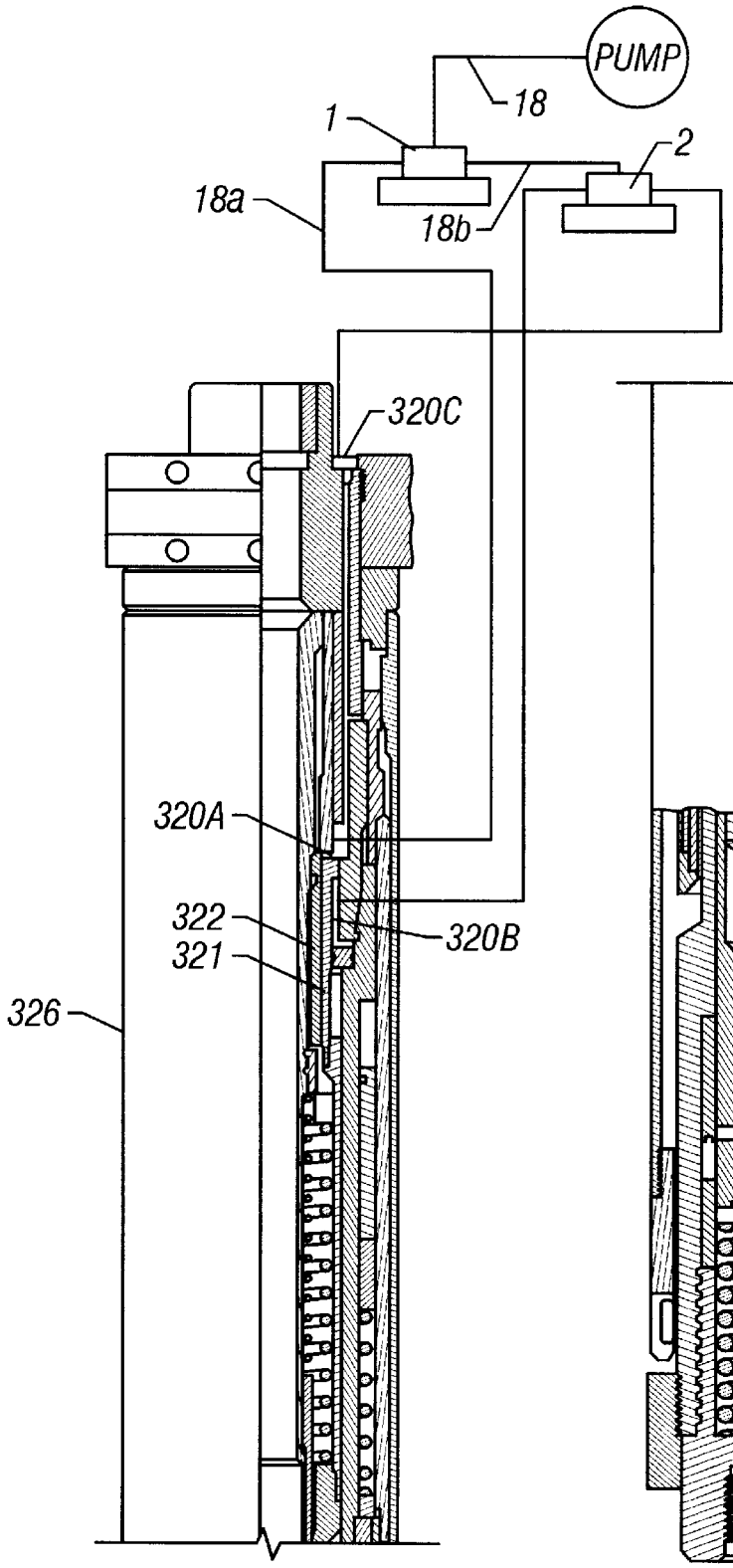
FIGS. 18A and 18B are longitudinal sectional views, with portions in side elevation, of an embodiment of the present invention wherein the hydraulic distributor is used to control a subsea control valve apparatus.
Figure 18B:
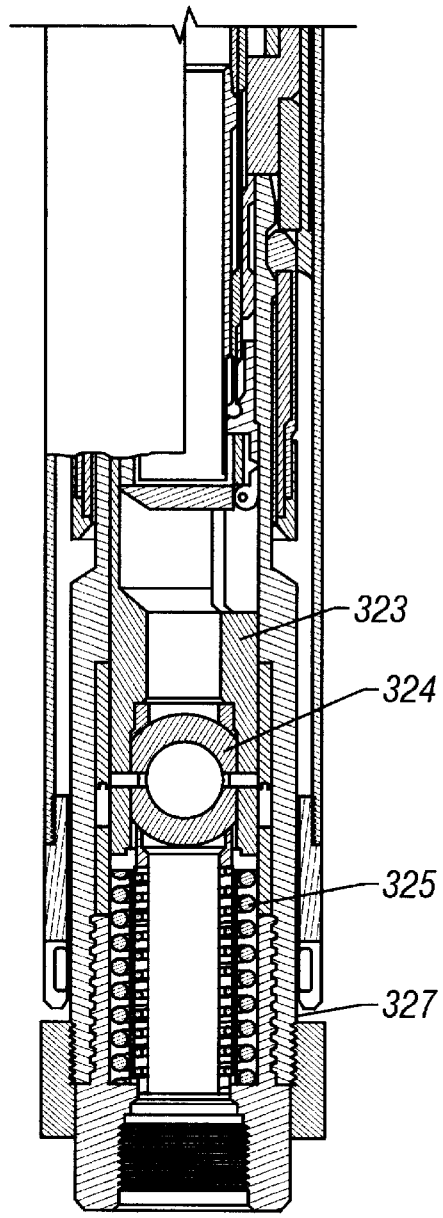

It should be noted that for discussion purposes, the hydraulic distributor 1 is shown in FIG. 17A as a diagrammatic sketch. The sketch is not intended to limit the location of the hydraulic distributor 1 as being external to the safety valve 310. The hydraulic distributor 1 can also be provided on or in a wall of the safety valve 310 or be provided on or in a wall of a tool string to which the safety valve 310 is a part of, for example. FIGS. 18A and 18B are longitudinal sectional views, with portions in side elevation, of an embodiment of the present invention wherein the hydraulic distributor 1 (shown as a diagrammatic sketch) is used to advantage to control a subsea control valve apparatus 320 such as that disclosed in U.S. Pat. No. 3,967,647 to Young. The subsea control valve apparatus 320 receives hydraulic fluid pressure from three hydraulic inlets 320A, 320B, and 320C. Hydraulic fluid pressure received by the first hydraulic inlet 320A acts to force the outer piston assembly 321 and the inner piston assembly 322 downward causing corresponding downward movement of the valve cage 323 which rotates the ball valve element 324 to an open position. To rotate the ball valve element 324 to a closed position, the pressure to the first hydraulic inlet 320A is bled off and the ball valve closure spring 325 shifts the valve cage 323 upwards.

Hydraulic fluid pressure received by the second hydraulic inlet 320B is used for an emergency shut in. In the event that a wireline tool is suspended in the well for perforating or the like, and an emergency condition dictates that the well be shut in before there is time to retrieve the wireline tool, hydraulic fluid pressure is directed to the second hydraulic inlet 320B. The flow forces the inner piston assembly 322 upwards which acts to force the valve cage 323 upwards. The combination of the hydraulic force and the force of the return spring 325 is adequate to cause the ball valve element 324 to cut wireline or cable.

Hydraulic fluid pressure received by the third hydraulic inlet 320C is used to release the control unit 326 from the valve assembly 327. The control unit 326 can be retrieved to the surface leaving the valve section 327 within the blowout preventer stack.

The embodiment of the present invention shown in FIG. 18A, utilizes two hydraulic distributors 1, 2 to supply hydraulic fluid pressure to the three hydraulic inlets 320A, 320B, 320C from a single control line 18. The first hydraulic distributor 1 receives flow from the main control line 18. Assuming the hydraulic distributor 1 is in its first position in which the hydraulic fluid pressure is able to flow to a first supply line 18*a* and prevented from flowing to a second supply line 18*b*, the flow is carried to the first hydraulic inlet 320A through the first supply line 18*a*. The hydraulic fluid pressure entering the first hydraulic inlet 320A forces the outer piston assembly 321 and the inner piston assembly 322 downward causing corresponding downward movement of the valve cage 323 which rotates the ball valve element 324 to an open position. To rotate the ball valve element 324 to a closed position, the pressure supplied to the first hydraulic inlet 320A is reduced and the ball valve closure spring 325 shifts the valve cage 323 upwards. In this manner, repeated opening and closing of the ball valve element 324 can be accomplished.

If an emergency condition dictates that the well be shut in, the pressure supplied by the main control line 18 can be varied to exceed predetermined switching parameters which act to switch the first hydraulic distributor 1 to its second position. In its second position, the hydraulic distributor 1 prevents flow to the first supply line 18*a* while enabling hydraulic fluid pressure to the second supply line 18*b*. In its second position, the hydraulic distributor 1 facilitates hydraulic fluid pressure to the second hydraulic distributor 2. Assuming the second hydraulic distributor 2 is in its first position, hydraulic fluid pressure is supplied to the second hydraulic inlet 320B which acts to force the valve cage 323 upwards with adequate force to cause the ball valve element 324 to cut the wireline or cable.

Additionally, by varying the hydraulic fluid pressure supplied by the main control line 18 to a pressure value that does not exceed the predetermined switching parameters of the first hydraulic distributor 1, but does exceed the predetermined switching parameters of the second hydraulic distributor 2, the hydraulic fluid pressure can be provided by the second hydraulic distributor 2 to the third hydraulic inlet 320C. As discussed above, supplying hydraulic fluid pressure to the third hydraulic inlet 320C acts to release the control unit 326 from the valve assembly 327.

Thus, by varying the hydraulic fluid pressure supplied by the main control line 18, the first hydraulic distributor 1 can be used to open and close the ball valve element 324, and also used to control a second hydraulic distributor 2 that provides hydraulic fluid pressure to additional hydraulic inlets 320B, 320C. In this way, the subsea control valve apparatus 320 can be oscillated between pressure states by a single control line 18.

It should be noted that in an alternate embodiment, tags and sensors are used to advantage on each hydraulic distributor. The sensors transmit information to the control surface by electrical lines, fiber optic lines, or the like. The transmitted information details the present position of each distributor and the pressure it is being subjected to. The information provided by the sensors ensures efficient manipulation of the hydraulic distributors from the single control line.

It should be noted that for discussion purposes, the hydraulic distributors 1, 2 are shown in FIG. 18A as a diagrammatic sketch. The sketch is not intended to limit the location of the hydraulic distributors 1, 2 as being external to the subsea control valve 320. The hydraulic distributors 1, 2 can also be provided on or in a wall of the subsea control valve 320 or be provided on or in a wall of a tool string to which the subsea control valve 310 is a part of, for example.

Figure 19A:
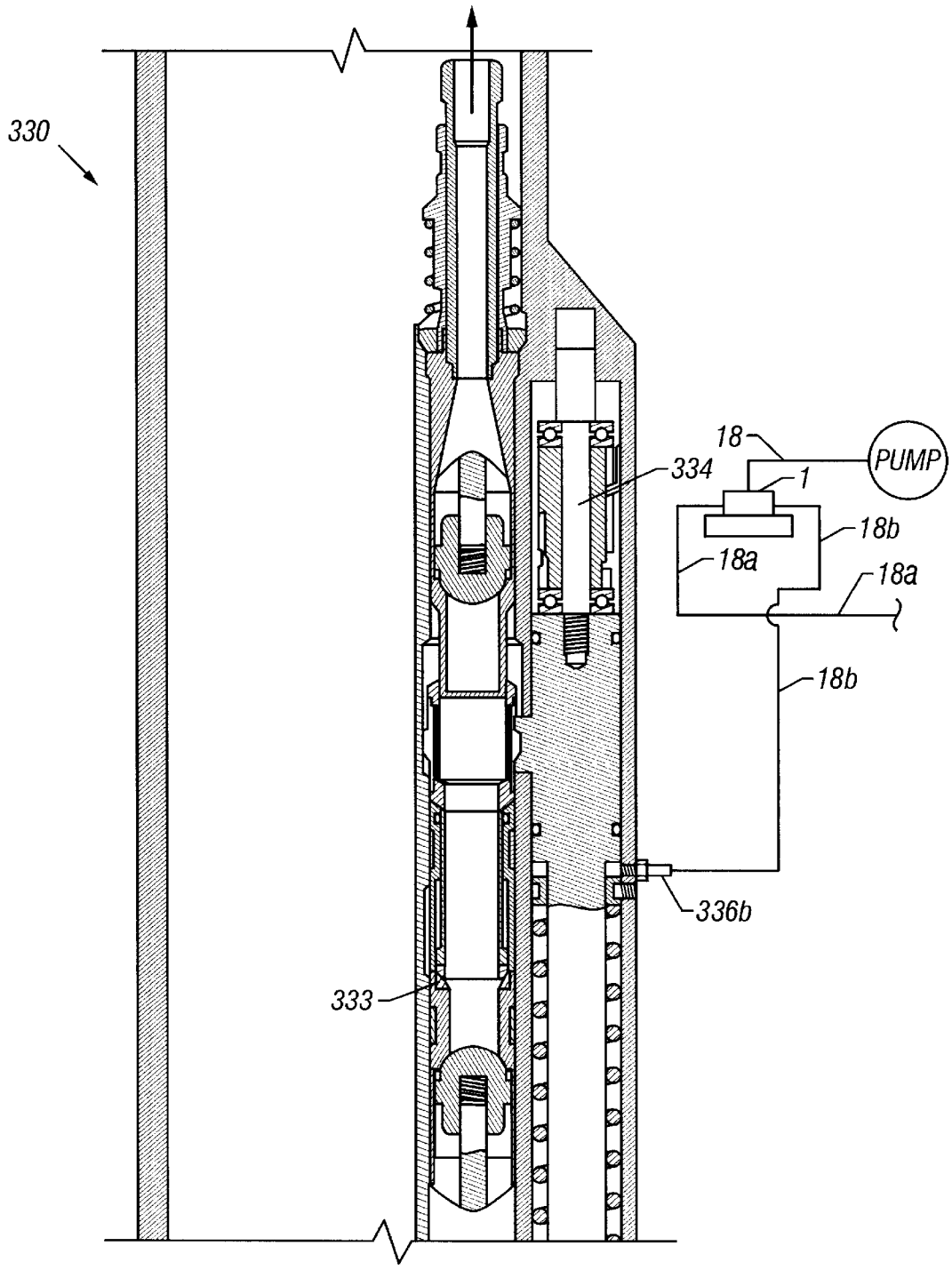
FIGS. 19A and 19B are elevational views, of an embodiment of the present invention wherein the hydraulic distributor is used to control a variable orifice gas lift valve.
Figure 19B:
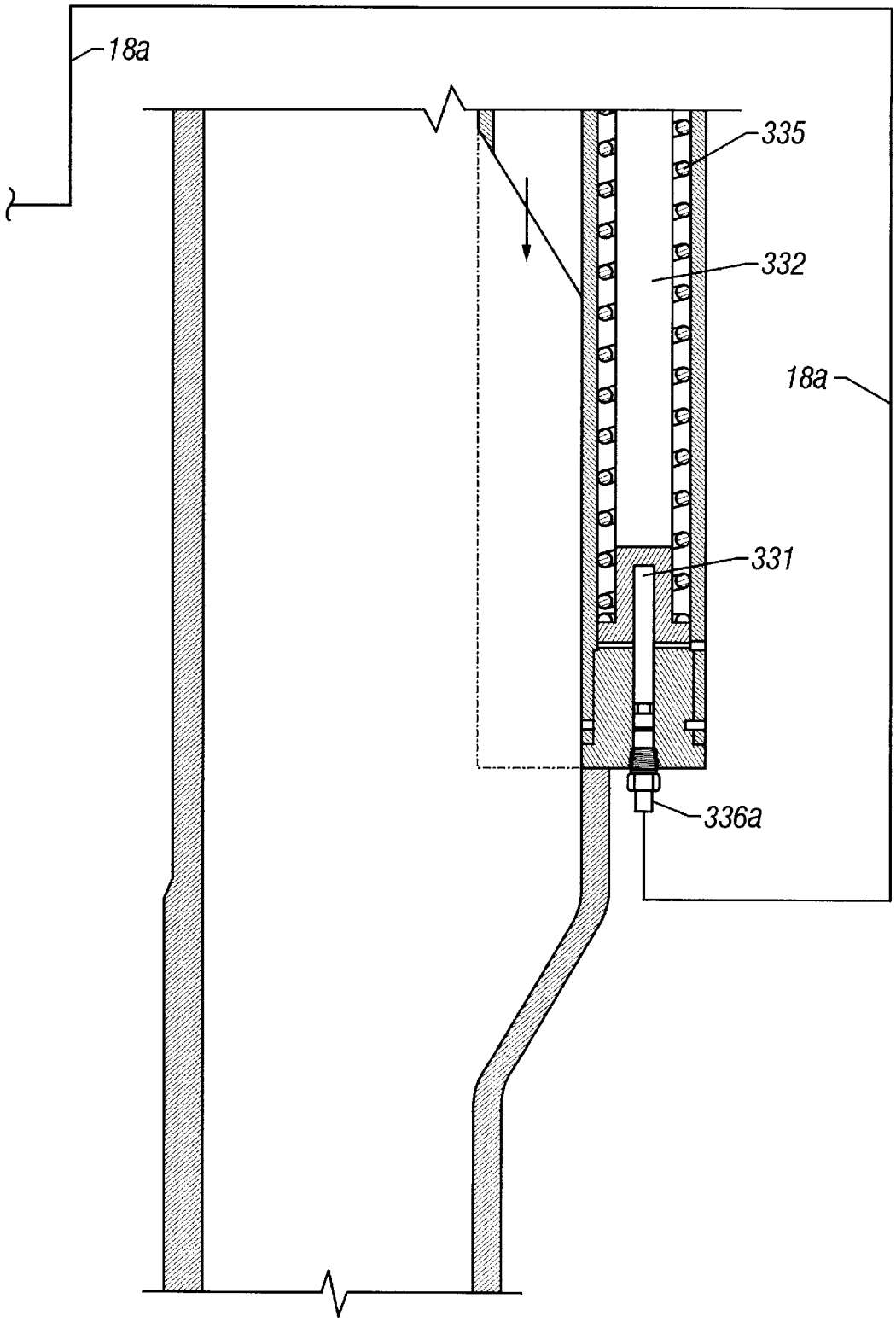

FIGS. 19A and 19B are elevational views, of an embodiment of the present invention wherein the hydraulic distributor 1 (shown as a diagrammatic sketch) is used to advantage to control a variable orifice gas lift valve 330 such as that disclosed in U.S. Pat, No. 5,971,004 to Pringle. The hydraulically operated gas lift valve 330 is comprised of a lower hydraulic actuating piston 331 operatively connected to a moveable piston 332, which is operatively connected to a variable orifice valve 333 and an upper hydraulic actuating piston 334. A spring 335 biases the moveable piston 332 thereby biasing the variable orifice valve 333 to a closed position. Hydraulic inlets 336*a* and 336*b* supply hydraulic pressure to the lower and upper hydraulic actuating pistons 331, 334 to move the pistons 331, 334 upward thereby opening the variable orifice valve 333.

A hydraulic distributor 1 (shown in FIG. 19A) receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the first hydraulic inlet 336*a* through the first supply line 18*a*. The hydraulic fluid pressure entering the hydraulic inlet 336*a* forces the lower hydraulic actuating piston 331 upward which acts to open the variable orifice valve 333.

The second supply line 18*b* of the hydraulic distributor 1 is in communication with the second hydraulic inlet 336*b*. Thus, varying the flow from the main control line 18 to switch the hydraulic distributor 1 from its first position to its second position, acts to supply hydraulic fluid pressure to the second hydraulic inlet 336*b* which forces the upper hydraulic actuating piston 334 upward to open the variable orifice valve 333.

By use of two independent pistons 331, 334 with varying strokes, the variable orifice valve 333 can be fully opened or opened to an intermediate position to control the fluid flow therethrough. By using the hydraulic distributor 1 to control the flow to one or the other hydraulic inlets 336*a*, 336*b*, the full opening, partial opening, and closing of the variable orifice valve 333 can be accomplished by varying the flow supplied to a single control line 18.

It should be noted that for discussion purposes, the hydraulic distributor 1 is shown in FIGS. 19A and 19B as a diagrammatic sketch. The sketch is not intended to limit the location of the hydraulic distributor 1 as being external to the gas lift valve 330. The hydraulic distributor 1 can also be provided on or in a wall of the gas lift valve 330 or be provided on or in a wall of a tool string to which the gas lift valve 330 is a part of, for example.

Figure 20:
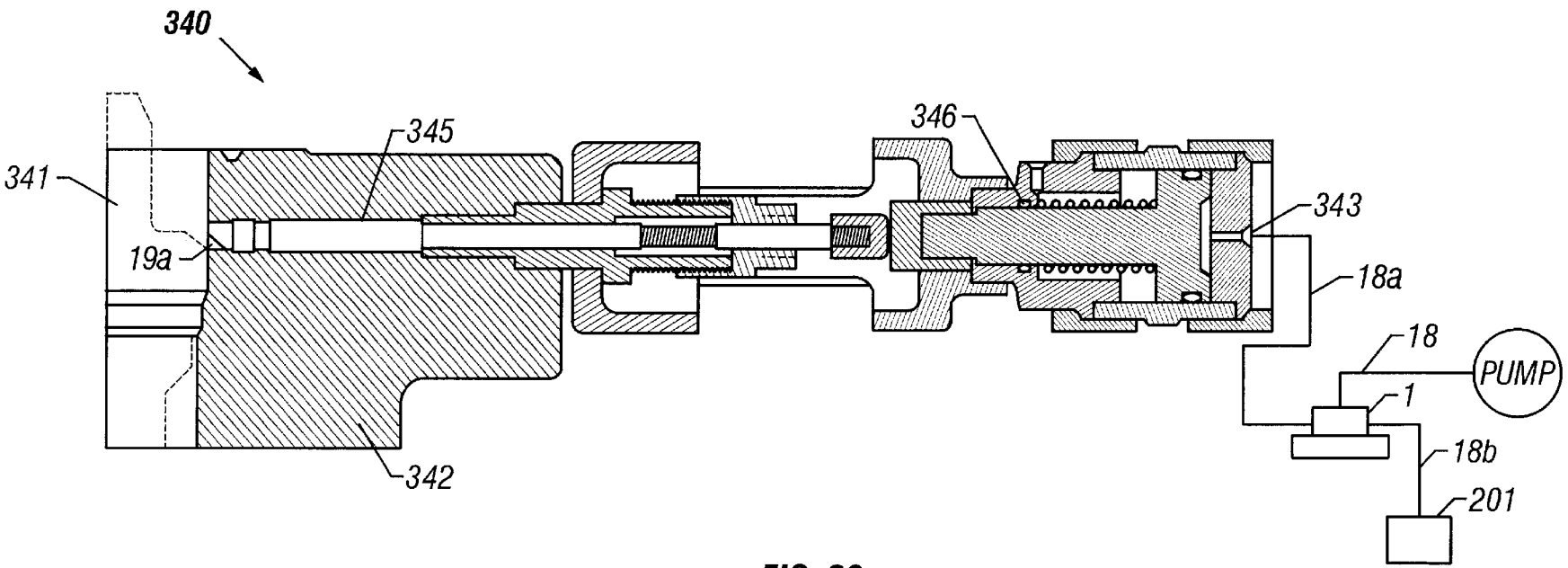
FIG. 20 is a diagrammatic sketch of an embodiment of the present invention wherein the hydraulic distributor is used to control a hydraulically actuated lock pin assembly.

FIG. 20 is a diagrammatic sketch of an embodiment of the present invention wherein the hydraulic distributor 1 is used to advantage to control a hydraulically actuated lock pin assembly 340 such as that disclosed in U.S. Pat. No. 4,770,250 to Bridges et al. The lock pin assembly 340 is for locking a pipe hanger 341 to a wellhead 342. Application of hydraulic fluid pressure to a hydraulic inlet 343 forces a piston 344 inward which, in turn, forces a lock pin 345 to wedge tightly against the pipe hanger 341 to provide a lock down force. The lock down force is relieved by bleeding off the pressure supplied to the hydraulic inlet 343 and lock pin 345 is returned to its initial position by the bias of a spring 346.

In FIG. 20, a hydraulic distributor 1 receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the hydraulic inlet 343 through the first supply line 18*a*. The hydraulic fluid pressure entering the hydraulic inlet 343 actuates the piston 344 which, in turn, forces the lock pin 345 to wedge tightly against the pipe hanger 341. Bleeding off the pressure from the main control line 18, in combination with the bias of the spring 346, acts to return the lock pin 345 to its initial position. In this manner, repeated locking and releasing of the pipe hanger 341 can be accomplished.

An additional hydraulic device 201 can also be actuated by the hydraulic distributor 1. As discussed earlier, by varying the pressure supplied by the main control line 18 to exceed predetermined switching parameters, the hydraulic distributor 1 can be switched from its first position to its second position. In its second position, the hydraulic distributor 1 prevents flow to the first supply line 18*a* while enabling hydraulic fluid pressure to the second supply line 18*b*. In its second position, the hydraulic distributor 1 facilitates hydraulic fluid pressure to an additional hydraulic device 201.

Thus, by varying the hydraulic fluid pressure supplied by the main control line 18, the hydraulic distributor 1 can be used to advantage to supply hydraulic fluid pressure to one or more hydraulic devices. The hydraulic distributor 1 only switches position upon exceeding predetermined switching pressure values, therefore, the flow to one or the other device can be varied without premature switching of the position of the distributor 1. In this way, individual devices can be oscillated between pressure states and one or more devices can be remotely controlled by a single control line 18.

It should be noted that for discussion purposes, the hydraulic distributor 1 is shown in FIG. 20 as a diagrammatic sketch. The sketch is not intended to limit the location of the hydraulic distributor 1 as being external to the lock pin assembly 340. The hydraulic distributor 1 can also be provided on or in a wall of the lock pin assembly 340 or be provided on or in a wall of a tool string to which the lock pin assembly 340 is a part of, for example.

Figure 21:
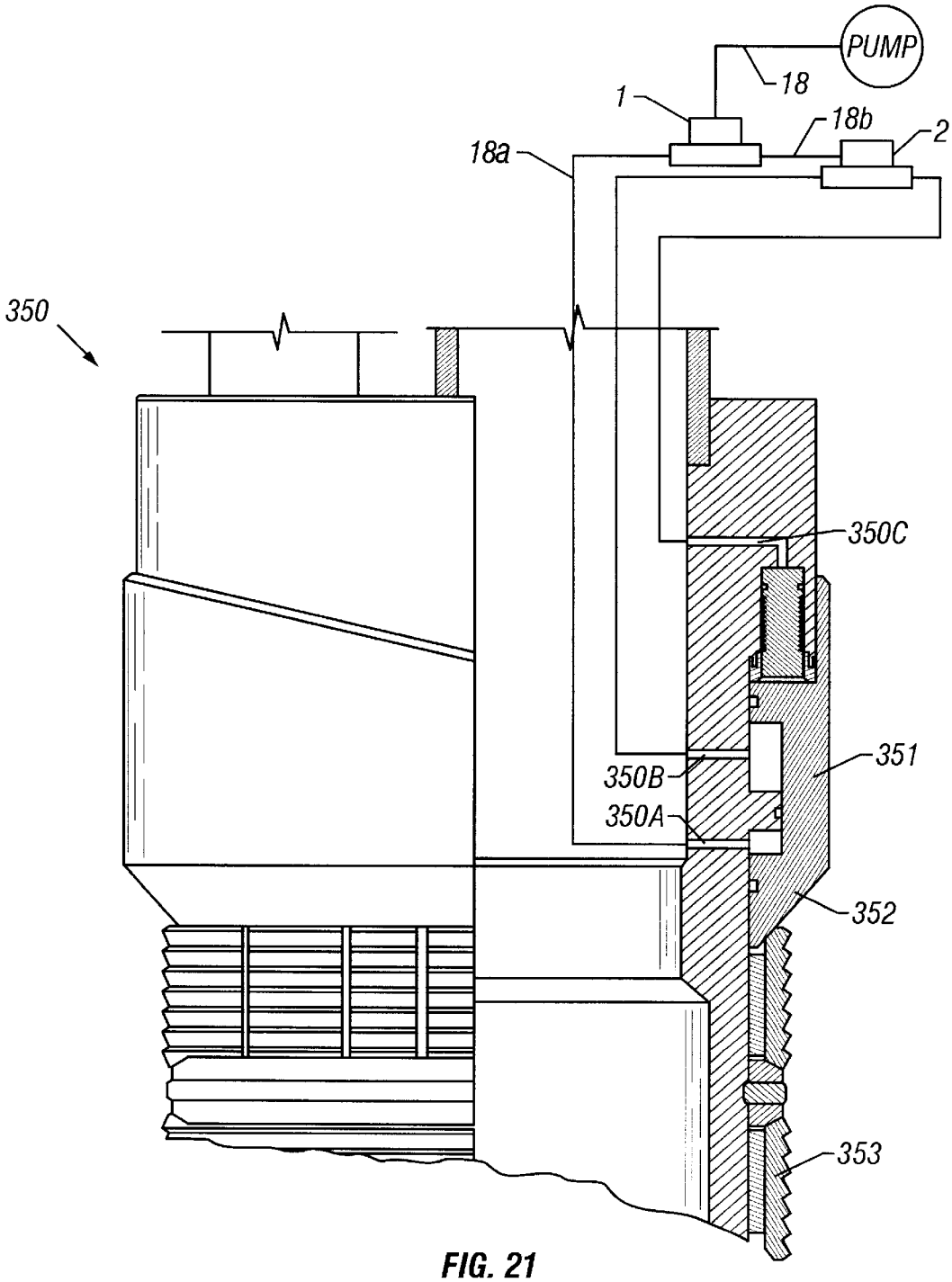
FIG. 21 is a cross-sectional view of an embodiment of the present invention wherein the hydraulic distributor is used to control a resettable packer.

FIG. 21 is a cross-sectional view of an of an embodiment of the present invention wherein the hydraulic distributor 1 (shown as a diagrammatic sketch) is used to advantage to control a resettable packer 350 such as that disclosed in U.S. Pat. No. 6,012,518 to Pringle. The resettable packer 350 receives hydraulic fluid pressure from three hydraulic inlets 350A, 350B, and 350C. Hydraulic fluid pressure received by the first hydraulic inlet 350A enables movement of a double acting piston 351, which drives a wedge 352 under a set of slips 353 thereby setting the packer 350. Hydraulic fluid pressure received by the second hydraulic inlet 350B enables the reverse movement of the double acting piston 351, which removes the wedge 352 from under the slips 353 thereby unsetting the packer 350. Finally, hydraulic fluid pressure received by the third hydraulic inlet 350C enables movement of a ratcheted piston 354 axially downward, coacting with the double acting piston 351, which drives the wedge 352 under the slips 353 thereby permanently setting the packer 350.

The embodiment of the present invention shown in FIG. 21, utilizes two hydraulic distributors 1, 2 to supply hydraulic fluid pressure to the three hydraulic inlets 350A, 350B, 350C from a single control line 18. The first hydraulic distributor 1 receives flow from the main control line 18. Assuming the hydraulic distributor 1 is in its first position in which the hydraulic fluid pressure is able to flow to a first supply line 18*a* and prevented from flowing to a second supply line 18*b*, the flow is carried to the first hydraulic inlet 350A through the first supply line 18*a*. The hydraulic fluid pressure entering the first hydraulic inlet 350A enables movement of a double acting piston 351, which drives the wedge 352 under the set of slips 353 thereby setting the packer 350.

To unset the packer 350, the hydraulic fluid pressure supplied by the main control line 18 can be varied to exceed predetermined switching parameters which act to switch the first hydraulic distributor 1 to its second position. In its second position, the hydraulic distributor 1 prevents flow to the first supply line 18*a* while enabling hydraulic fluid pressure to the second supply line 18*b*. In its second position, the hydraulic distributor 1 facilitates hydraulic fluid pressure to the second hydraulic distributor 2. Assuming the second hydraulic distributor 2 is in its first position, hydraulic fluid pressure is supplied to the second hydraulic inlet 350B which enables the reverse movement of the double acting piston 351, which removes the wedge 352 from under the slips 353 thereby unsetting the packer 350.

Additionally, by varying the hydraulic fluid pressure supplied by the main control line 18 to a pressure value that does not exceed the predetermined switching parameters of the first hydraulic distributor 1, but does exceed the predetermined switching parameters of the second hydraulic distributor 2, the hydraulic fluid pressure can be provided by the second hydraulic distributor 2 to the third hydraulic inlet 350C. As discussed above, supplying hydraulic fluid pressure to the third hydraulic inlet 350C acts to permanently set the packer 350.

Thus, by varying the hydraulic fluid pressure supplied by the main control line 18, the first and second hydraulic distributors 1, 2 can be used to set and unset the packer 350, as well as permanently set the packer 350. In this way, the resettable packer 350 can be set and reset by a single control line 18.

It should be noted that for discussion purposes, the hydraulic distributor 1 is shown in FIG. 21 as a diagrammatic sketch. The sketch is not intended to limit the location of the hydraulic distributor 1 as being external to the resettable packer 350. The hydraulic distributor 1 can also be provided on or in a wall of the resettable packer 350 or be provided on or in a wall of a tool string to which the resettable packer 350 is a part of, for example.

FIGS. 22A–22D are continuations of each other and are elevational views, in quarter section, of an embodiment of the present invention wherein the hydraulic distributor 1 (shown as a diagrammatic sketch) is used to advantage to control a safety valve 360 such as that disclosed in U.S. Pat. No. 4,660,646 to Blizzard. The safety valve 360 is comprised of an actuating piston 361 maneuverable by hydraulic fluid pressure supplied to hydraulic inlet ports 362A, 362B. Application of hydraulic fluid pressure to the first hydraulic inlet port 362A forces the piston 361 downward, which acts to open the flapper valve 363. Application of hydraulic fluid pressure to the second hydraulic inlet port 362B forces the piston 361 upward, which acts to close the flapper valve 363.

A hydraulic distributor 1 (shown in FIG. 22A) receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the first hydraulic inlet 362A through the first supply line 18*a*. The hydraulic fluid pressure entering the first hydraulic inlet 362A forces the actuating piston 361 downward, which acts to open the flapper valve 363. Varying the flow from the main control line 18 to switch the hydraulic distributor 1 from its first position to its second position, acts to supply hydraulic fluid pressure to the second hydraulic inlet 362B which forces the actuating piston 361 upward to open the flapper valve 363. In this manner, the safety valve 360 can be opened and closed by hydraulic fluid pressure supplied by a single control line 18.

Figure 22D:
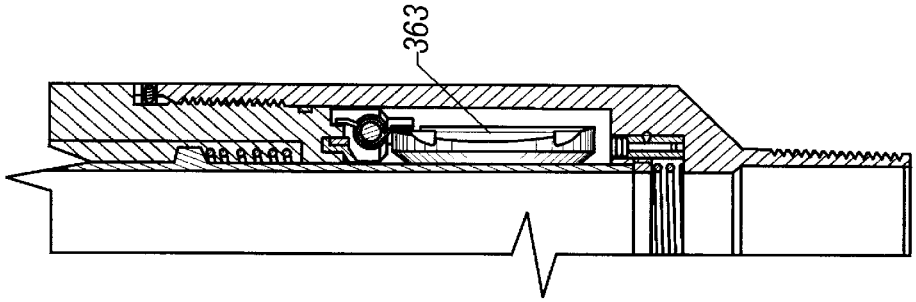
FIGS. 22A–22D are continuations of each other and are elevational views, in quarter section, of an embodiment of the present invention wherein the hydraulic distributor is used to control a safety valve.
Figure 22C:
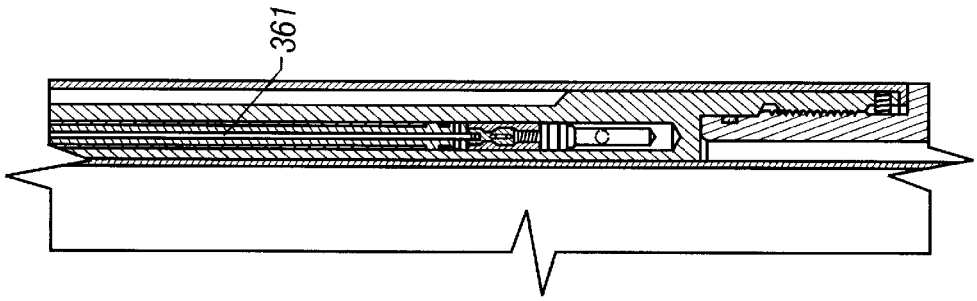
Figure 22B:
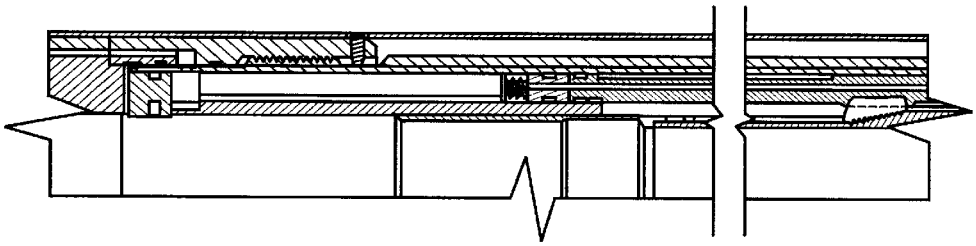
Figure 22A:
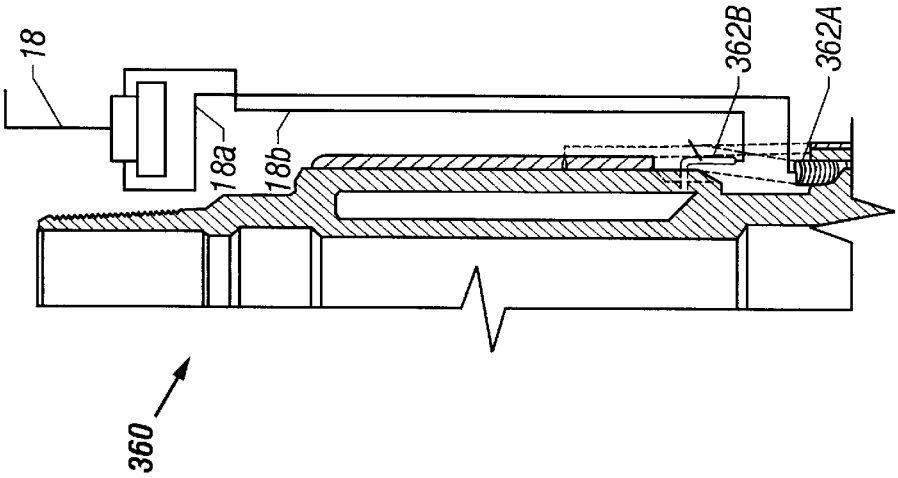

It should be noted that for discussion purposes, the hydraulic distributor 1 is shown in FIG. 22A as a diagrammatic sketch. The sketch is not intended to limit the location of the hydraulic distributor 1 as being external to the safety valve 360. The hydraulic distributor 1 can also be provided on or in a wall of the safety valve 360 or be provided on or in a wall of a tool string to which the safety valve 360 is a part of, for example.

Figure 23A:
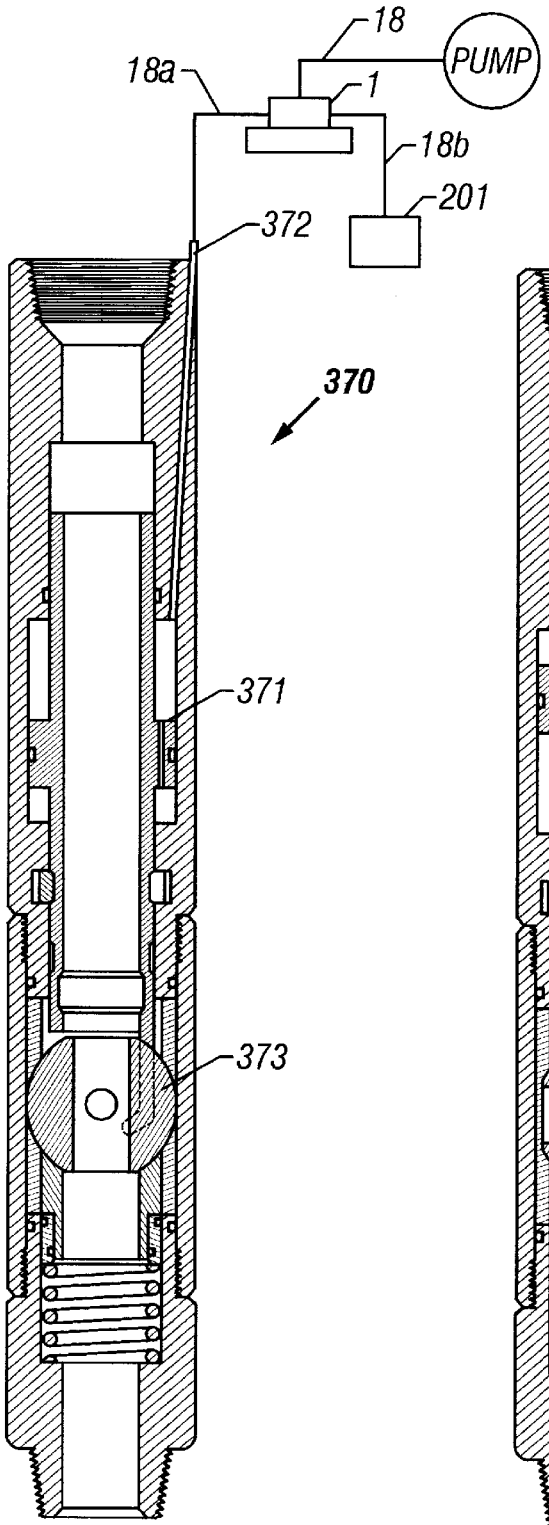
FIGS. 23A–23B are sectional views of an embodiment of the present invention wherein the hydraulic distributor is used to control a formation isolation valve.
Figure 23B:
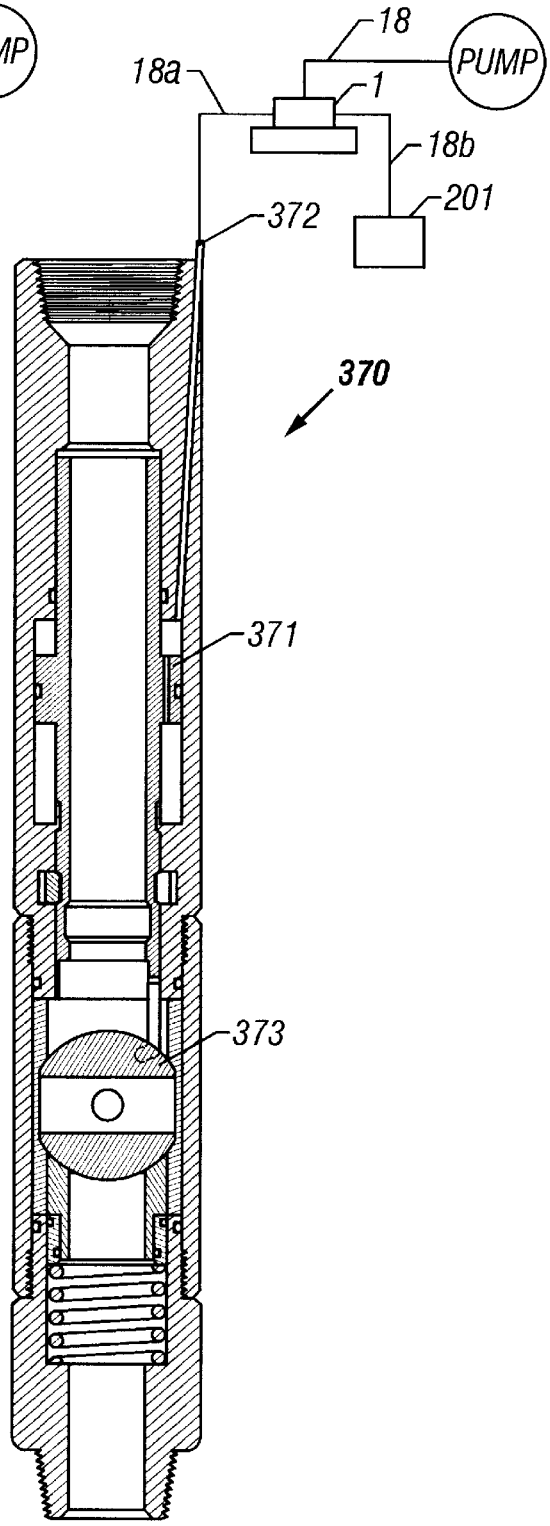

FIGS. 23A–23B are sectional views of an embodiment of the present invention wherein the hydraulic distributor 1

(shown as a diagrammatic sketch) is used to advantage to control a formation isolation valve (FIV) 370 such as that disclosed in U.S. Pat. No. 6,085,845 to Patel et al. FIG. 23A illustrates the FIV valve in its open position and FIG. 23B illustrates the FIV valve in its closed position. The FIV valve 370 is comprised of an actuating piston 371 maneuverable by fluid pressure supplied to a fluid inlet port 372. Although the fluid utilized by the '845 patent is gas, hydraulic fluid pressure can also be used to advantage. Application of hydraulic fluid pressure to the fluid inlet port 372 forces the piston 371 downward, which acts to open the valve element 373. Bleeding off the pressure supplied to the fluid inlet port 372 enables the piston 371 to return to its upper position in which the valve element 373 is closed.

In FIG. 23A, a hydraulic distributor 1 receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the fluid inlet port 372 through the first supply line 18*a*. The hydraulic fluid pressure entering the hydraulic inlet 372 forces the actuating piston 371 downward and the valve element 373 is opened.

In FIG. 23B, the pressure supplied by the main control line 18 is varied to exceed a predetermined switching parameter, and the hydraulic distributor 1 is switched from its first position to its second position. In its second position, the hydraulic distributor 1 prevents flow to the first supply line 18*a* while enabling hydraulic fluid pressure to the second supply line 18*b*. The fluid pressure supplied to the fluid inlet port 372 is thus bled off and the actuating piston 371 returns to its upper position in which the valve element 373 is closed. At the same time, the hydraulic distributor 1 can now supply hydraulic fluid pressure to an additional hydraulic device 201.

Thus, by varying the hydraulic fluid pressure supplied by the main control line 18, the hydraulic distributor 1 can be used open and close the FIV valve 370, and can be used to control an additional hydraulic device 201. All such controls are performed by varying hydraulic fluid pressure supplied by a single control line 18.

It should be noted that for discussion purposes, the hydraulic distributor 1 is shown in FIGS. 23A and 23B as a diagrammatic sketch. The sketch is not intended to limit the location of the hydraulic distributor 1 as being external to the formation isolation valve 370. The hydraulic distributor 1 can also be provided on or in a wall of the formation isolation valve 370 or be provided on or in a wall of a tool string to which the formation isolation valve 370 is a part of, for example.

Figure 24A:
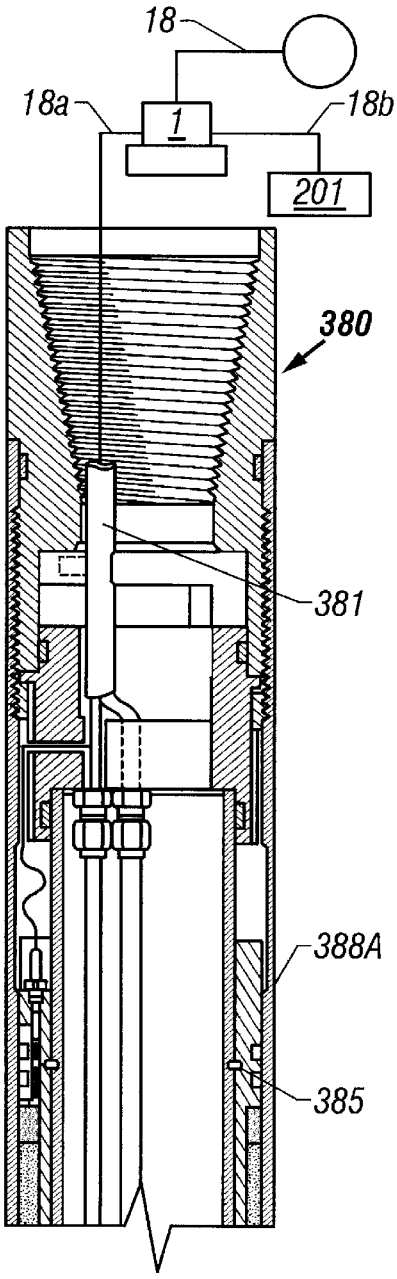
FIGS. 24A–24C are continuations of each other and form an elevational view in cross section of an embodiment of the present invention wherein the hydraulic distributor is used to advantage to control an emergency disconnect tool.
Figure 24B:
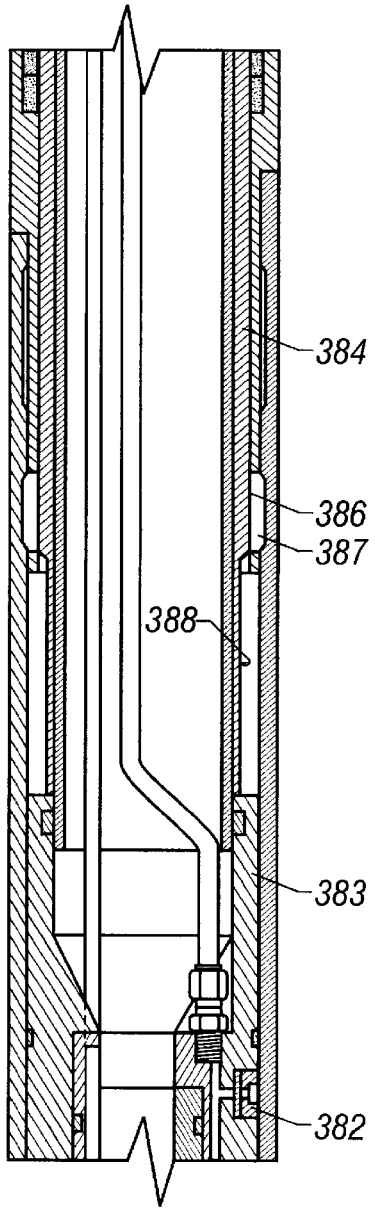
Figure 24C:
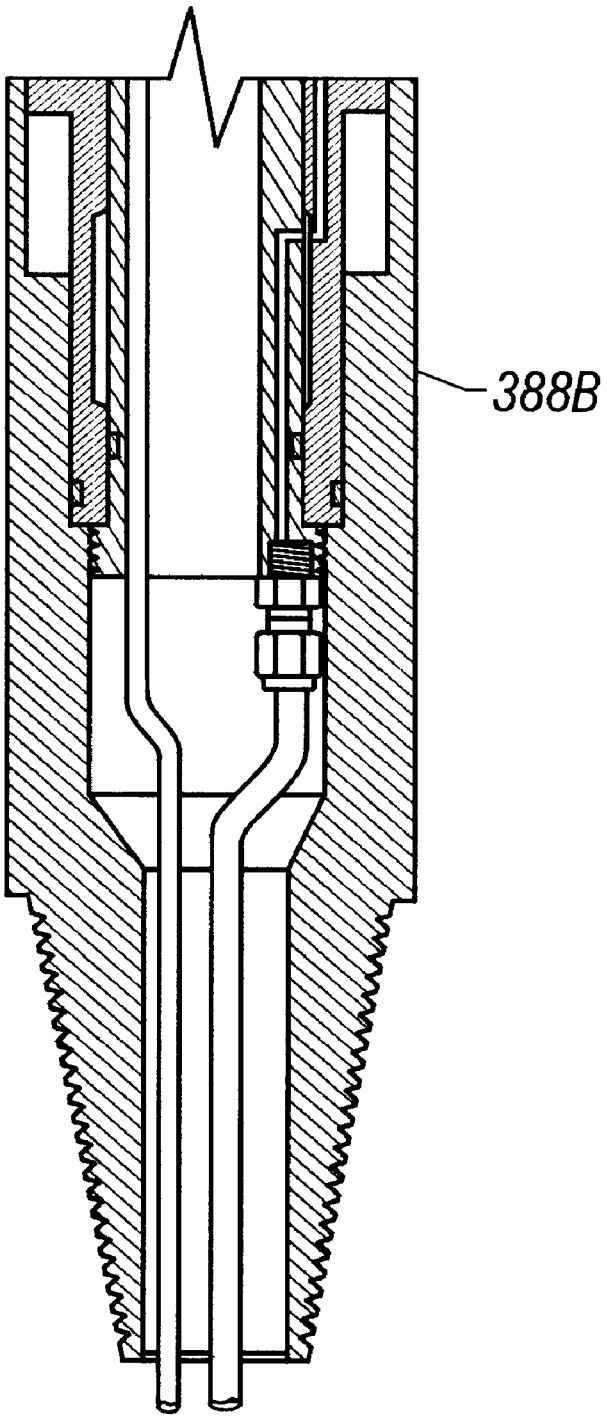

FIGS. 24A–24C are continuations of each other and form an elevational view in cross section of an embodiment of the present invention wherein the hydraulic distributor 1 (shown as a diagrammatic sketch) is used to advantage to control an emergency disconnect tool 380 such as that disclosed in U.S. Pat. No. 5,323,853 to Leismer et al. The emergency disconnect tool 380 can be used to disconnect a tool from a drilling assembly by hydraulic or electrical actuation. The hydraulic actuation is performed by supplying hydraulic fluid pressure to the inlet port 381 sufficient to overcome a rupture disk 382. Rupture of the disk 382 allows the hydraulic fluid to move the piston 383 thereby moving the sleeve 384 upwardly, shearing the C-ring 385, moving the locking shoulder 386 from behind the dogs 387, and the aligning recess 388 with the dogs 387, thereby releasing the tool parts 388A, 388B.

A hydraulic distributor 1 (shown in FIG. 24A) receives flow from a main control line 18. Assuming the hydraulic distributor 1 is in its first position in which the hydraulic fluid pressure is able to flow to a first supply line 18*a* and prevented from flowing to a second supply line 18*b*, the flow is carried to the fluid inlet port 381 through the first supply line 18*a*. The hydraulic fluid pressure entering the inlet port 381 ruptures the rupture disk 382 allowing the hydraulic fluid to move the piston 383 thereby moving the sleeve 384 upwardly, shearing the C-ring 385, moving the locking shoulder 386 from behind the dogs 387, and aligning the recess 388 with the dogs 387, thereby releasing the tool parts 388A and 388B.

As discussed earlier, by varying the hydraulic fluid pressure supplied by the main control line 18, the hydraulic distributor 1 can be switched to a second position in which an additional hydraulic device 201 is controlled. Thus, the hydraulic distributor 1 can be used to actuate the emergency disconnect tool 380 and control an additional. hydraulic device 201 by varying hydraulic fluid pressure supplied by a single control line 18.

It should be noted that for discussion purposes, the hydraulic distributor 1 is shown in FIG. 24A as a diagrammatic sketch. The sketch is not intended to limit the location of the hydraulic distributor 1 as being external to the emergency disconnect tool 380. The hydraulic distributor 1 can also be provided on or in a wall of the emergency disconnect tool 380 or be provided on or in a wall of a tool string to which the emergency disconnect tool 380 is a part of, for example.

The above embodiments of the present invention are exemplary of the applications of the present invention and are not limiting on the scope of the present invention. The present invention can be used to advantage to provide any number of hydraulic devices, tools and actuators with hydraulic fluid pressure supplied by a single control line. For example, FIG. 25 provides a diagrammatic sketch further demonstrating the hydraulic distributor 1 of the present invention used to advantage to control multiple tools and multiple other hydraulic distributors from a single control line.

Figure 25:
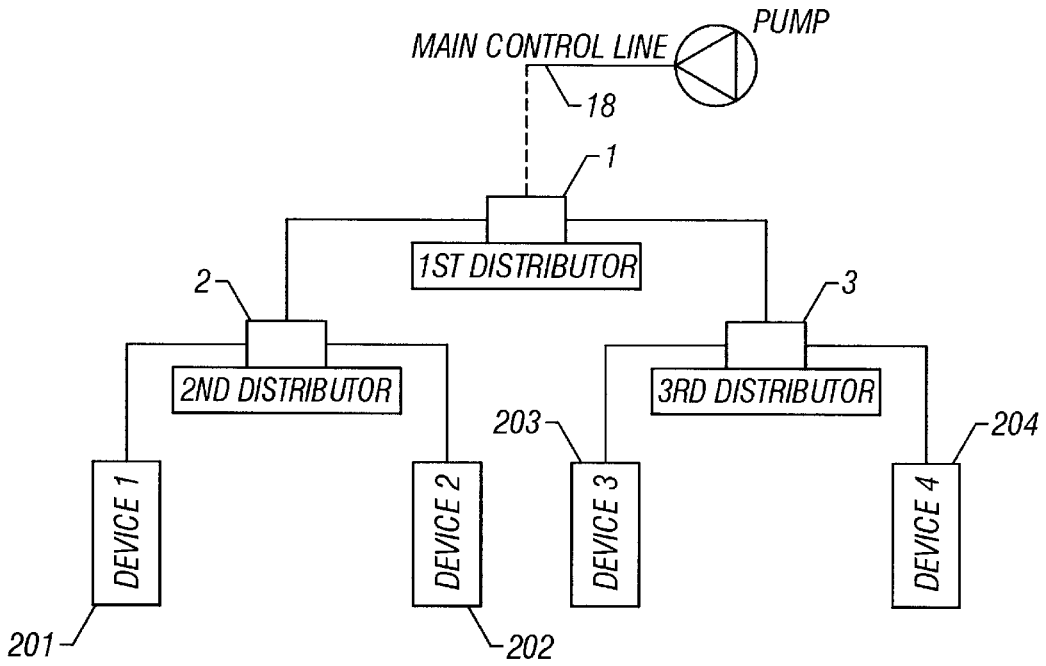
FIG. 25 is a diagrammatic sketch of a series of hydraulic distributors used to control a plurality of tools from a single control line.

As shown in FIG. 25, flow from a pump is carried through a main control line 18 to a first distributor 1. Depending upon the pressure of the hydraulic fluid pressure and the position of the shuttle sleeve 60 within the first hydraulic distributor 1, the flow is directed through one of the outlet ports 20*a*, 20*b* to a second distributor 2 or a third distributor 3. If the flow from the main control line 18 is directed from the first distributor 1 to the second distributor 2, then depending upon the pressure of the hydraulic fluid pressure and the position of the shuttle sleeve 60 within the second hydraulic distributor 2, the flow is distributed to a first hydraulic device 201 or a second hydraulic device 202. Likewise, if the flow from the main control line 18 is directed from the first distributor 1 to the third distributor 3, then depending upon the hydraulic fluid pressure and the position of the shuttle sleeve 60 within the third hydraulic distributor 3, the flow is distributed to a third hydraulic device 203 or a fourth hydraulic device 204. In this way, several tools and distributors can be operated by altering the hydraulic fluid pressure through a single control line 18.

Figure 25A:
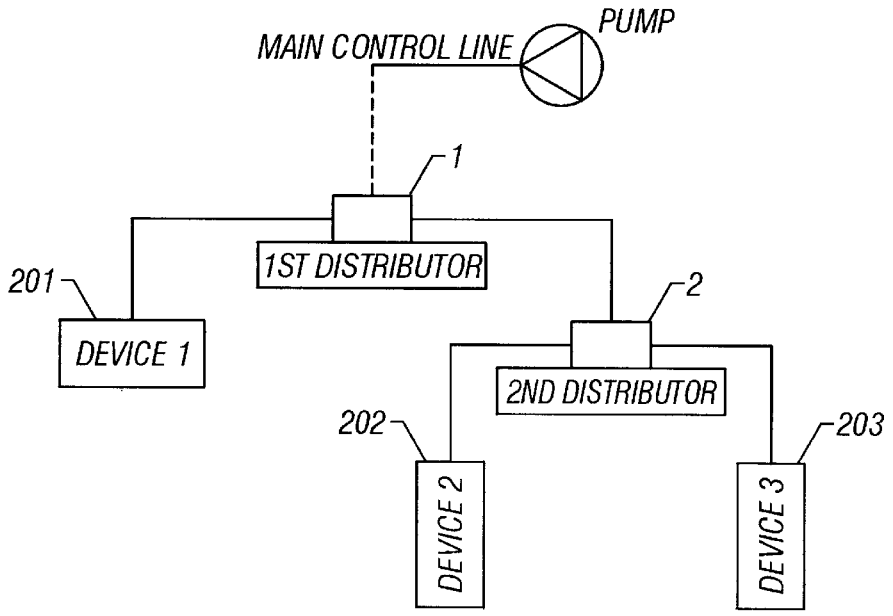
FIG. 25A is a diagrammatic sketch of a series of hydraulic distributors used to control a plurality of tools from a single control line.
Figure 25B:
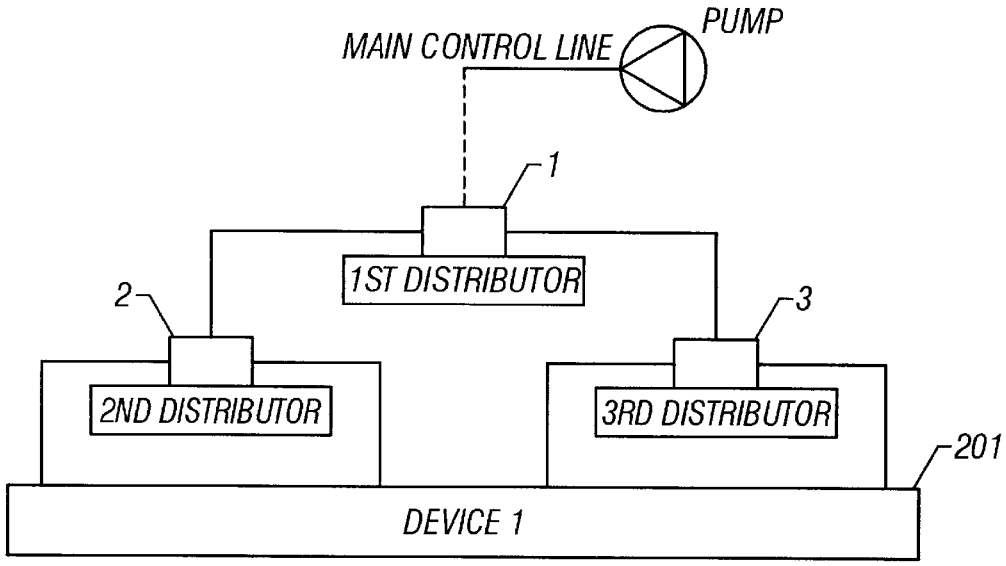
FIG. 25B is a diagrammatic sketch of a series of hydraulic distributors used to control a single tool from a single control line.
Figure 25C:
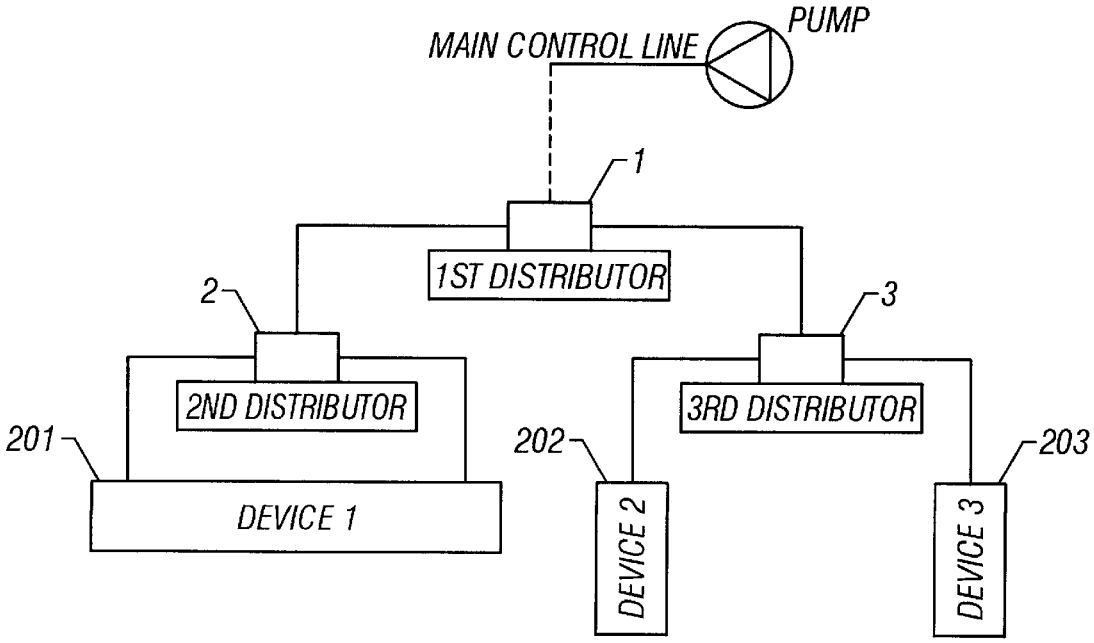
FIG. 25C is a diagrammatic sketch of a series of hydraulic distributors used to control a plurality of tools from a single control line.

Likewise, FIGS. 25A, 25B, and 25C display additional exemplary configurations whereby the present invention is utilized to control additional distributors and tools. In FIG. 25A, the first distributor 1 is used control a first hydraulic device 201 and a second distributor 2 that controls a second device 202 and a third device 203. In FIG. 25B, a first distributor 1 is used to control a second distributor 2 and a third distributor 3 that are used in combination to control a single hydraulic device 201. FIG. 25C illustrates a first distributor 1 used to control a second distributor 2 that control a first hydraulic device 201, and used to control a third distributor 3 that controls a second hydraulic device 202 and a third hydraulic device 203. It should be noted that the above configurations are illustrative and exemplary and not intended to limit the scope of the present invention. The hydraulic distributor 1 of the present invention can be used in any number of configurations to control any number of other distributors and other tools.

The invention being thus described, it will be obvious that the same may be varied in many ways. As one example, in an illustrated embodiment of the hydraulic distributor 1 of the present invention, the shuttle sleeve 60 is biased towards its upper position by a shuttle sleeve spring 62 and maneuvered to its lower position by the same. However, other means such as gas charges, or hydraulic actuators can be used to advantage to accomplish the same. Such variations are not to be regarded as a departure from the spirit and scope of the invention, and all such modifications as would be obvious to one skilled in the art are intended to be included within the scope of the following non-limiting claims.

We claim:

1. A ratchet assembly for incremental manipulation of one or more downhole devices, the ratchet assembly comprising:

(a) a hydraulic distributor having an inlet port, one or more first outlet ports, one or more second outlet ports, and a toggle valve, the inlet port for receipt of pressurized fluid, the toggle valve responsive to the pressurized fluid to selectively distribute the pressurized fluid to the one or more first outlet ports and the one or more second outlet ports; and (b) a ratchet assembly having at least one driving rod, the ratchet assembly incrementally moving the at least one driving rod in a first direction in response to pressurized fluid through the one or more first outlet ports and in a second direction in response to pressurized fluid through the one or more second outlet ports, the at least one driving rod for manipulating the one or more downhole devices.

2. The ratchet assembly of claim 1, wherein the inlet port is adapted to receive pressurized fluid from a control line.

3. The ratchet assembly of claim 1, wherein the one or more downhole devices are selected from sleeve valves, ball valves, packers, formation isolation valves, gas lift valves, locks, sliding sleeves.

4. The ratchet assembly of claim 1, wherein the ratchet assembly is provided in a wall of the one or more downhole devices.

5. The ratchet assembly of claim 1, wherein the one or more downhole devices are part of a tool string.

6. The ratchet assembly of claim 5, wherein the ratchet assembly is provided in a wall of the tool string.

7. The ratchet assembly of claim 1 further comprising at least one first piston and spring responsive to pressurized fluid through the one or more first outlet ports and at least one second piston and spring responsive to pressurized fluid through the one or more second outlet ports.

8. The ratchet assembly of claim 1 further comprising a mechanical override that mechanically switches the toggle valve upon a predetermined displacement of the at least one driving rod.

9. A ratchet assembly, comprising:

(a) at least one driving rod, (b) at least one first inlet port, (c) at least one second inlet port, (d) at least one first linearly actuated ratchet for incrementally advancing the at least one driving rod in a first direction in response to hydraulic pressure through the at least one first inlet port, and (e) at least one second linearly actuated ratchet for incrementally advancing the at least one driving rod in a second direction in response to hydraulic pressure through the at least one second inlet port.

10. The ratchet assembly of claim 9, wherein the driving rod controls one or more hydraulic devices.

11. The ratchet assembly of claim 10, wherein the one or more hydraulic devices are selected from sleeve valves, ball valves, packers, formation isolation valves, gas lift valves, locks, and sliding sleeves.

12. The ratchet assembly of claim 9, wherein the at least one first ratchet has a piston and a return spring.

13. The ratchet assembly of claim 9, wherein the at least one second ratchet has a piston and a return spring.

14. The ratchet assembly of claim 9, having a plurality of control lines to control the hydraulic pressure applied to the at least one first ratchet and the at least one second ratchet.

15. The apparatus of claim 10, wherein the alternate flowpath member extends from the perforated section of casing to the non-perforated section of casing.

16. The ratchet assembly of claim 10, wherein the one or more hydraulic devices are part of a tool string.

17. The ratchet assembly of claim 16, wherein the ratchet assembly is provided in a wall of the tool string.

18. The ratchet assembly of claim 9, having a hydraulic distributor to toggle the hydraulic pressure between the at least one first inlet port and the at least one second inlet port.

19. The ratchet assembly of claim 18, further having a mechanical override activated when the at least one driving rod exceeds a pre-determined displacement, the mechanical override activated to mechanically toggle the hydraulic pressure from the hydraulic distributor.

20. A method of incrementally manipulating a downhole device, the method comprising:

(a) providing a ratchet assembly having at least one driving rod, the ratchet assembly adapted to incrementally manipulate the driving rod in response to fluid flow, the driving rod adapted to incrementally manipulate the downhole device, (b) applying hydraulic pressure to the ratchet assembly to incrementally move the at least one driving rod in a first direction, and (c) applying hydraulic pressure to the ratchet assembly to incrementally move the at least one driving rod in a second direction.

21. The method of claim 20, further providing a hydraulic distributor to control the application of the hydraulic pressure to the ratchet assembly.

22. A method of incrementally manipulating a downhole device, the method comprising:

(a) providing a ratchet assembly having at least one driving rod, at least one first inlet port and at least one second inlet port;

(b) providing a toggle valve;

(c) applying hydraulic fluid pressure to the toggle valve to distribute the fluid pressure to the at least one first inlet port to incrementally move the at least one driving rod in a first direction; and (d) applying hydraulic fluid pressure to the toggle valve to distribute the fluid pressure to the at least one second inlet port to incrementally move the at least one driving rod in a second direction.

* * * * *

UNITED STATES PATENT AND TRADEMARK OFFICE

CERTIFICATE OF CORRECTION

PATENT NO. : 6,505,684 B2 
DATED : January 14, 2003
INVENTOR(S) : Christophe M. Rayssiguier et al.

It is certified that error appears in the above-identified patent and that said Letters Patent is hereby corrected as shown below:

Title page,
Item [74], *Attorney, Agent, or Firm*, delete "Jeffrey W.", and insert -- Jeffrey E. --

Column 5,
Lines 58-61, delete "inventionAny number of seal arrangements of the present invention. Any number of seal could be utilized to advantage in the present invention", and insert -- invention. Any number of seal arrangements could be utilized to advantage in the present invention --.

Signed and Sealed this

Twenty-eighth Day of September, 2004

JON W. DUDAS
*Director of the United States Patent and Trademark Office*